US010541482B2

(12) United States Patent
Sasame et al.

(10) Patent No.: US 10,541,482 B2
(45) Date of Patent: Jan. 21, 2020

(54) ELECTRICAL CONNECTOR WITH CAVITY BETWEEN TERMINALS

(71) Applicants: AMPHENOL FCI ASIA PTE. LTD., Singapore (SG); AMPHENOL FCI CONNECTORS SINGAPORE PTE. LTD., Singapore (SG); Motomu Kajiura, Oota-ku, Tokyo (JP); Masahiko Motoyama, Yokohama-shi, Kanagawa (JP)

(72) Inventors: Naotaka Sasame, Saitama (JP); Motomu Kajiura, Tokyo (JP); Masahiko Motoyama, Kanagawa (JP)

(73) Assignees: Amphenol FCI Asia Pte. Ltd., Singapore (SG); Amphenol FCI Connectors Singapore Pte. Ltd., Singapore (SG)

( * ) Notice: Subject to any disclaimer, the term of this patent is extended or adjusted under 35 U.S.C. 154(b) by 0 days.

(21) Appl. No.: 15/742,244

(22) PCT Filed: Jul. 7, 2016

(86) PCT No.: PCT/SG2016/050317
§ 371 (c)(1),
(2) Date: Jan. 5, 2018

(87) PCT Pub. No.: WO2017/007429
PCT Pub. Date: Jan. 12, 2017

(65) Prior Publication Data

US 2018/0198220 A1 Jul. 12, 2018

(30) Foreign Application Priority Data

Jul. 7, 2015 (SG) ..... 10201505358W

(51) Int. Cl.
*H01R 12/71* (2011.01)
*H01R 13/6585* (2011.01)
(Continued)

(52) U.S. Cl.
CPC ..... *H01R 12/716* (2013.01); *H01R 13/502* (2013.01); *H01R 13/514* (2013.01);
(Continued)

(58) Field of Classification Search
CPC .. H01R 12/716; H01R 13/502; H01R 13/514; H01R 13/631; H01R 12/57; H01R 13/26;
(Continued)

(56) References Cited

U.S. PATENT DOCUMENTS 2,996,710 A 8/1961 Pratt
3,002,162 A 9/1961 Garstang
(Continued)

FOREIGN PATENT DOCUMENTS

CN 1179448 C 12/2004
CN 1799290 A 7/2006
(Continued)

OTHER PUBLICATIONS

International Search Report and Written Opinion for International Application No. PCT/SG2016/050317 dated Oct. 18, 2016.
(Continued)

*Primary Examiner* — Travis S Chambers
(74) *Attorney, Agent, or Firm* — Wolf, Greenfield & Sacks, P.C.

(57) ABSTRACT

An electrical connector includes a housing, first and second sets of terminals and a spacer. The housing has a first sidewall, a second sidewall spaced apart from the first sidewall and a cavity between the first and second sidewalls. The first set of terminals is disposed in the cavity adjacent to the first sidewall. The second set of terminals is disposed
(Continued)

in the cavity adjacent to the second sidewall. The spacer is disposed in the cavity between the first and second sets of terminals.

25 Claims, 17 Drawing Sheets

(51) Int. Cl.
*H01R 13/502* (2006.01)
*H01R 13/514* (2006.01)
*H01R 13/631* (2006.01)
*H01R 12/57* (2011.01)
*H01R 13/26* (2006.01)

(52) U.S. Cl.
CPC ..... *H01R 13/631* (2013.01); *H01R 13/6585* (2013.01); *H01R 12/57* (2013.01); *H01R 13/26* (2013.01)

(58) Field of Classification Search
CPC ..... H01R 13/6585; H01R 13/6586; H01R 13/658
USPC ..... 439/82, 108, 497, 947, 607.05, 607.06, 439/607.08, 634, 701, 712, 717, 724
See application file for complete search history.

(56) References Cited

U.S. PATENT DOCUMENTS 3,134,950 A 5/1964 Cook
3,322,885 A 5/1967 May et al.
3,786,372 A 1/1974 Epis et al.
3,825,874 A 7/1974 Peverill
3,863,181 A 1/1975 Glance et al.
4,155,613 A 5/1979 Brandeau
4,195,272 A 3/1980 Boutros
4,276,523 A 6/1981 Boutros et al.
4,371,742 A 2/1983 Manly
4,408,255 A 10/1983 Adkins
4,447,105 A 5/1984 Ruehl
4,471,015 A 9/1984 Ebneth et al.
4,484,159 A 11/1984 Whitley
4,490,283 A 12/1984 Kleiner
4,518,651 A 5/1985 Wolfe, Jr.
4,519,664 A 5/1985 Tillotson
4,519,665 A 5/1985 Althouse et al.
4,632,476 A 12/1986 Schell
4,636,752 A 1/1987 Saito
4,682,129 A 7/1987 Bakermans et al.
4,687,267 A * 8/1987 Header ..... H01R 12/725 439/607.07
4,728,762 A 3/1988 Roth et al.
4,751,479 A 6/1988 Parr
4,761,147 A 8/1988 Gauthier
4,806,107 A 2/1989 Arnold et al.
4,846,724 A 7/1989 Sasaki et al.
4,846,727 A 7/1989 Glover et al.
4,878,155 A 10/1989 Conley
4,948,922 A 8/1990 Varadan et al.
4,970,354 A 11/1990 Iwasa et al.
4,975,084 A 12/1990 Fedder et al.
4,992,060 A 2/1991 Meyer
5,000,700 A 3/1991 Masubuchi et al.
5,066,236 A 11/1991 Broeksteeg
5,141,454 A 8/1992 Garrett et al.
5,150,086 A 9/1992 Ito
5,166,527 A 11/1992 Solymar
5,168,252 A 12/1992 Naito
5,168,432 A 12/1992 Murphy et al.
5,176,538 A 1/1993 Hansell, III et al.
5,266,055 A 11/1993 Naito et al.
5,280,257 A 1/1994 Cravens et al.
5,287,076 A 2/1994 Johnescu et al.
5,334,050 A 8/1994 Andrews
5,340,334 A 8/1994 Nguyen
5,346,410 A 9/1994 Moore, Jr.
5,429,520 A 7/1995 Morlion et al.
5,429,521 A 7/1995 Morlion et al.
5,433,617 A 7/1995 Morlion et al.
5,433,618 A 7/1995 Morlion et al.
5,456,619 A 10/1995 Belopolsky et al.
5,461,392 A 10/1995 Mott et al.
5,474,472 A 12/1995 Niwa et al.
5,484,310 A 1/1996 McNamara et al.
5,496,183 A 3/1996 Soes et al.
5,499,935 A 3/1996 Powell
5,551,893 A 9/1996 Johnson
5,562,497 A 10/1996 Yagi et al.
5,597,328 A 1/1997 Mouissie
5,651,702 A 7/1997 Hanning et al.
5,669,789 A 9/1997 Law
5,796,323 A 8/1998 Uchikoba et al.
5,831,491 A 11/1998 Buer et al.
5,924,899 A 7/1999 Paagman
5,981,869 A 11/1999 Kroger
5,982,253 A 11/1999 Perrin et al.
6,019,616 A 2/2000 Yagi et al.
6,152,747 A 11/2000 McNamara
6,168,469 B1 1/2001 Lu
6,174,202 B1 1/2001 Mitra
6,174,203 B1 1/2001 Asao
6,174,944 B1 1/2001 Chiba et al.
6,217,372 B1 4/2001 Reed
6,293,827 B1 9/2001 Stokoe
6,296,496 B1 10/2001 Trammel
6,299,438 B1 10/2001 Shagian et al.
6,299,483 B1 10/2001 Cohen et al.
6,328,601 B1 12/2001 Yip et al.
6,347,962 B1 2/2002 Kline
6,350,134 B1 2/2002 Fogg et al.
6,364,711 B1 4/2002 Berg et al.
6,375,510 B2 4/2002 Asao
6,398,588 B1 6/2002 Bickford
6,409,543 B1 6/2002 Astbury, Jr. et al.
6,482,017 B1 11/2002 Van Doorn
6,503,103 B1 1/2003 Cohen et al.
6,506,076 B2 1/2003 Cohen et al.
6,517,360 B1 2/2003 Cohen
6,530,790 B1 3/2003 McNamara et al.
6,537,087 B2 3/2003 McNamara et al.
6,554,647 B1 4/2003 Cohen et al.
6,565,387 B2 5/2003 Cohen
6,579,116 B2 6/2003 Brennan et al.
6,582,244 B2 6/2003 Fogg et al.
6,595,802 B1 7/2003 Watanabe et al.
6,602,095 B2 8/2003 Astbury, Jr. et al.
6,607,402 B2 8/2003 Cohen et al.
6,609,922 B2 8/2003 Torii
6,616,864 B1 9/2003 Jiang et al.
6,652,318 B1 11/2003 Winings et al.
6,655,966 B2 12/2003 Rothermel et al.
6,709,294 B1 3/2004 Cohen et al.
6,713,672 B1 3/2004 Stickney
6,726,492 B1 * 4/2004 Yu ..... H01R 23/688 434/74
6,743,057 B2 6/2004 Davis et al.
6,776,659 B1 8/2004 Stokoe et al.
6,786,771 B2 9/2004 Gailus
6,814,619 B1 11/2004 Stokoe et al.
6,830,489 B2 12/2004 Aoyama
6,872,085 B1 3/2005 Cohen et al.
6,979,226 B2 12/2005 Otsu et al.
7,044,794 B2 5/2006 Consoli et al.
7,057,570 B2 6/2006 Irion, II et al.
7,074,086 B2 7/2006 Cohen et al.
7,108,556 B2 9/2006 Cohen et al.
7,163,421 B1 1/2007 Cohen et al.
7,285,018 B2 10/2007 Kenny et al.
7,335,063 B2 2/2008 Cohen et al.
7,407,413 B2 8/2008 Minich
7,494,383 B2 2/2009 Cohen et al.
7,540,781 B2 6/2009 Kenny et al.

(56) References Cited

U.S. PATENT DOCUMENTS 7,581,990 B2 9/2009 Kirk et al.
7,588,464 B2 9/2009 Kim
7,722,401 B2 5/2010 Kirk et al.
7,731,537 B2 6/2010 Amleshi et al.
7,753,731 B2 7/2010 Cohen et al.
7,771,233 B2 8/2010 Gailus
7,794,240 B2 9/2010 Cohen et al.
7,794,278 B2 9/2010 Cohen et al.
7,806,729 B2 10/2010 Nguyen et al.
7,874,873 B2 1/2011 Do et al.
7,887,371 B2 2/2011 Kenny et al.
7,887,379 B2 2/2011 Kirk
7,906,730 B2 3/2011 Atkinson et al.
7,914,304 B2 3/2011 Cartier et al.
7,985,097 B2 7/2011 Gulla
8,018,733 B2 9/2011 Jia
8,083,553 B2 12/2011 Manter et al.
8,182,289 B2 5/2012 Stokoe et al.
8,215,968 B2 7/2012 Cartier et al.
8,216,001 B2 7/2012 Kirk
8,262,411 B2 * 9/2012 Kondo ..... H01R 13/6658 439/607.01
8,272,877 B2 9/2012 Stokoe et al.
8,371,875 B2 2/2013 Gailus
8,382,524 B2 2/2013 Khilchenko et al.
8,657,627 B2 2/2014 McNamara et al.
8,715,003 B2 5/2014 Buck et al.
8,771,016 B2 7/2014 Atkinson et al.
8,864,506 B2 * 10/2014 Little ..... H01R 13/658 439/108
8,864,521 B2 10/2014 Atkinson et al.
8,926,377 B2 1/2015 Kirk et al.
8,944,831 B2 2/2015 Stoner et al.
8,998,642 B2 4/2015 Manter et al.
9,004,942 B2 4/2015 Paniauqa
9,011,177 B2 4/2015 Lloyd et al.
9,022,806 B2 5/2015 Cartier, Jr. et al.
9,028,281 B2 5/2015 Kirk et al.
9,124,009 B2 9/2015 Atkinson et al.
9,219,335 B2 12/2015 Atkinson et al.
9,225,085 B2 12/2015 Cartier, Jr. et al.
9,257,794 B2 2/2016 Wanha et al.
9,300,074 B2 3/2016 Gailus
9,337,585 B1 * 5/2016 Yang ..... H01R 13/6583
9,450,344 B2 9/2016 Cartier, Jr. et al.
9,484,674 B2 11/2016 Cartier, Jr. et al.
9,509,101 B2 11/2016 Cartier, Jr. et al.
9,520,689 B2 12/2016 Cartier, Jr. et al.
9,640,915 B2 * 5/2017 Phillips ..... H01R 13/6471
9,692,183 B2 * 6/2017 Phillips ..... H01R 13/6471
9,843,135 B2 12/2017 Guetig et al.
9,997,871 B2 * 6/2018 Zhong ..... H01R 24/28
10,122,129 B2 11/2018 Milbrand, Jr. et al.
10,243,304 B2 3/2019 Kirk et al.
2001/0042632 A1 11/2001 Manov et al.
2001/0046810 A1 11/2001 Cohen et al.
2002/0042223 A1 4/2002 Belopolsky et al.
2002/0061671 A1 5/2002 Torii
2002/0089464 A1 7/2002 Joshi
2002/0098738 A1 7/2002 Astbury et al.
2002/0111068 A1 8/2002 Cohen et al.
2002/0111069 A1 8/2002 Astbury et al.
2003/0119360 A1 6/2003 Jiang et al.
2004/0005815 A1 1/2004 Mizumura et al.
2004/0020674 A1 2/2004 McFadden et al.
2004/0115968 A1 6/2004 Cohen
2004/0121652 A1 6/2004 Gailus
2004/0196112 A1 10/2004 Welbon et al.
2004/0259419 A1 12/2004 Payne et al.
2005/0048818 A1 * 3/2005 Pan ..... H01R 23/6873 439/108
2005/0070160 A1 3/2005 Cohen et al.
2005/0133245 A1 6/2005 Katsuyama et al.
2005/0176835 A1 8/2005 Kobayashi et al.
2005/0233610 A1 10/2005 Tutt et al.
2005/0283974 A1 12/2005 Richard et al.
2005/0287869 A1 12/2005 Kenny et al.
2006/0068640 A1 3/2006 Gailus
2006/0255876 A1 11/2006 Kushta et al.
2007/0004282 A1 1/2007 Cohen et al.
2007/0021001 A1 1/2007 Laurx et al.
2007/0037419 A1 2/2007 Sparrowhawk
2007/0042639 A1 2/2007 Manter et al.
2007/0054554 A1 3/2007 Do et al.
2007/0059961 A1 3/2007 Cartier et al.
2007/0218765 A1 9/2007 Cohen et al.
2008/0194146 A1 8/2008 Gailus
2008/0246555 A1 10/2008 Kirk et al.
2008/0248658 A1 10/2008 Cohen et al.
2008/0248659 A1 10/2008 Cohen et al.
2008/0248660 A1 10/2008 Kirk et al.
2009/0011641 A1 1/2009 Cohen et al.
2009/0011645 A1 1/2009 Laurx et al.
2009/0035955 A1 2/2009 McNamara
2009/0061661 A1 3/2009 Shuey et al.
2009/0117386 A1 5/2009 Vacanti et al.
2009/0239395 A1 9/2009 Cohen et al.
2009/0258516 A1 10/2009 Hiew et al.
2009/0291593 A1 11/2009 Atkinson et al.
2009/0305533 A1 12/2009 Feldman et al.
2010/0048058 A1 2/2010 Morgan et al.
2010/0081302 A1 4/2010 Atkinson et al.
2010/0124851 A1 5/2010 Xiong et al.
2010/0203772 A1 8/2010 Mao et al.
2010/0294530 A1 11/2010 Atkinson et al.
2011/0003509 A1 1/2011 Gailus
2011/0104948 A1 5/2011 Girard, Jr. et al.
2011/0143605 A1 6/2011 Pepe
2011/0212649 A1 9/2011 Stokoe et al.
2011/0212650 A1 9/2011 Amleshi et al.
2011/0230095 A1 9/2011 Atkinson et al.
2011/0230096 A1 9/2011 Atkinson et al.
2011/0256739 A1 10/2011 Toshiyuki et al.
2011/0287663 A1 11/2011 Gailus et al.
2012/0094536 A1 4/2012 Khilchenko et al.
2012/0156929 A1 6/2012 Manter et al.
2012/0184154 A1 7/2012 Frank et al.
2012/0202363 A1 8/2012 McNamara et al.
2012/0202386 A1 8/2012 McNamara et al.
2012/0214344 A1 8/2012 Cohen et al.
2013/0012038 A1 1/2013 Kirk et al.
2013/0017733 A1 1/2013 Kirk et al.
2013/0078870 A1 3/2013 Milbrand, Jr.
2013/0109232 A1 5/2013 Paniaqua
2013/0196553 A1 8/2013 Gailus
2013/0217263 A1 8/2013 Pan
2013/0225006 A1 8/2013 Khilchenko et al.
2013/0237100 A1 * 9/2013 Affeltranger ..... H01R 4/2433 439/701
2013/0316590 A1 11/2013 Hon
2014/0004724 A1 1/2014 Cartier, Jr. et al.
2014/0004726 A1 1/2014 Cartier, Jr. et al.
2014/0004746 A1 1/2014 Cartier, Jr. et al.
2014/0057498 A1 2/2014 Cohen
2014/0273557 A1 9/2014 Cartier, Jr. et al.
2014/0273627 A1 9/2014 Cartier, Jr. et al.
2014/0377992 A1 12/2014 Chang et al.
2015/0056856 A1 2/2015 Atkinson et al.
2015/0072546 A1 * 3/2015 Li ..... H01R 13/6585 439/96
2015/0111401 A1 * 4/2015 Guo ..... H01R 13/6596 439/95
2015/0111427 A1 4/2015 Foxconn
2015/0126068 A1 * 5/2015 Fang ..... H01R 13/6587 439/607.23
2015/0236451 A1 8/2015 Cartier, Jr. et al.
2015/0236452 A1 8/2015 Cartier, Jr. et al.
2015/0255904 A1 * 9/2015 Ito ..... H01R 12/721 439/88
2015/0255926 A1 9/2015 Paniagua
2016/0149343 A1 5/2016 Atkinson et al.
2018/0062323 A1 3/2018 Kirk et al.
2018/0145438 A1 5/2018 Cohen
2018/0219331 A1 8/2018 Cartier et al.

(56) References Cited

U.S. PATENT DOCUMENTS

FOREIGN PATENT DOCUMENTS

| | | | |
|---|---|---|---|
| CN | 2896615 | Y | 5/2007 |
| CN | 2930006 | Y | 8/2007 |
| CN | 101176389 | A | 5/2008 |
| CN | 201323275 | Y | 10/2009 |
| CN | 101600293 | A | 12/2009 |
| CN | 201374434 | Y | 12/2009 |
| CN | 101790818 | A | 7/2010 |
| CN | 101120490 | B | 11/2010 |
| CN | 201846527 | U | 5/2011 |
| CN | 102239605 | A | 11/2011 |
| CN | 101600293 | B | 5/2012 |
| CN | 102598430 | A | 7/2012 |
| CN | 202395248 | U | 8/2012 |
| CN | 203690614 | U | 7/2014 |
| CN | 104409906 | A | 3/2015 |
| DE | 60216728 | T2 | 11/2007 |
| EP | 1018784 | A1 | 7/2000 |
| EP | 1779472 | A1 | 5/2007 |
| EP | 2169770 | A2 | 3/2010 |
| EP | 2405537 | A1 | 1/2012 |
| GB | 1272347 | A | 4/1972 |
| JP | H3-156761 | A2 | 7/1991 |
| JP | 07302649 | A | 11/1995 |
| JP | 2001-510627 | A | 7/2001 |
| JP | 2002-151190 | A2 | 5/2002 |
| JP | 2006-344524 | A | 12/2006 |
| MX | 9907324 | A | 8/2000 |
| WO | WO 88/05218 | A1 | 7/1988 |
| WO | WO 98/35409 | A1 | 8/1998 |
| WO | WO 2004/059794 | A2 | 7/2004 |
| WO | WO 2004/059801 | A1 | 7/2004 |
| WO | WO 2006/039277 | A1 | 4/2006 |
| WO | WO 2007/005597 | A2 | 1/2007 |
| WO | WO 2007/005599 | A1 | 1/2007 |
| WO | WO 2008/124057 | A1 | 10/2008 |
| WO | WO 2010/030622 | A1 | 3/2010 |
| WO | WO 2010/039188 | A1 | 4/2010 |
| WO | WO 2017/007429 | A1 | 1/2017 |

OTHER PUBLICATIONS

International Preliminary Report on Patentability for International Application No. PCT/SG2016/050317 dated Jan. 18, 2018.
International Search Report and Written Opinion for International Application No. PCT/CN2017/108344 dated Aug. 1, 2018.
Chinese Office Action for Application No. 201680051491.X dated Apr. 30, 2019.
CN 201680051491.X, Apr. 30, 2019, Chinese Office Action.
Extended European Search Report for European Application No. EP 11166820.8 dated Jan. 24, 2012.
International Search Report and Written Opinion for International Application No. PCT/US2010/056482 dated Mar. 14, 2011.
International Preliminary Report on Patentability for International Application No. PCT/US2010/056482 dated May 24, 2012.
International Search Report and Written Opinion for International Application No. PCT/US2011/026139 dated Nov. 22, 2011.
International Preliminary Report on Patentability for International Application No. PCT/US2011/026139 dated Sep. 7, 2012.
International Search Report and Written Opinion for International Application No. PCT/US2012/023689 dated Sep. 12, 2012.
International Preliminary Report on Patentability for International Application No. PCT/US2012/023689 dated Aug. 15, 2013.
International Search Report and Written Opinion for International Application No. PCT/US2012/060610 dated Mar. 29, 2013.
International Search Report and Written Opinion for International Application No. PCT/US2015/012463 dated May 13, 2015.
International Search Report and Written Opinion for International Application No. PCT/US2017/047905 dated Dec. 4, 2017.
International Search Report with Written Opinion for International Application No. PCT/US2006/025562 dated Oct. 31, 2007.
International Search Report and Written Opinion for International Application No. PCT/US2005/034605 dated Jan. 26, 2006.
International Search Report and Written Opinion for International Application No. PCT/US2011/034747 dated Jul. 28, 2011.
[No Author Listed], Carbon Nanotubes for Electromagnetic Interference Shielding. SBIR/STTR. Award Information. Program Year 2001. Fiscal Year 2001. Materials Research Institute, LLC. Chu et al. Available at http://sbir.gov/sbirsearch/detail/225895. Last accessed Sep. 19, 2013.
[No Author Listed], High Speed Backplane Connectors. Tyco Electronics. Product Catalog No. 1773095. Revised Dec. 2008 1-40 pages.
[No Author Listed], Military Fibre Channel High Speed Cable Assembly. www.gore.com. 2008. [last accessed Aug. 2, 2012 via Internet Archive: Wayback Machine http://web.archive.org] Link archived: http://www.gore.com/en.sub.--xx/products/cables/copper/networking/militar-y/military.sub.--fibre. Last archive date Apr. 6, 2008.
Beaman, High Performance Mainframe Computer Cables. 1997 Electronic Components and Technology Conference. 1997;911-7.
Reich et al., Microwave Theory and Techniques. Boston Technical Publishers, Inc. 1965;182-91.
Shi et al, Improving Signal Integrity in Circuit Boards by Incorporating Absorbing Materials. 2001 Proceedings. 51st Electronic Components and Technology Conference, Orlando FL. 2001:1451-56.

* cited by examiner (A-A)

(B-B)

ELECTRICAL CONNECTOR WITH CAVITY BETWEEN TERMINALS

RELATED APPLICATIONS

This application is the U.S. National Stage of and claims priority to and the benefit of International Patent Application Number PCT/SG2016/050317, entitled "ELECTRICAL CONNECTOR" filed on Jul. 7, 2016, which the benefit of and priority to Singapore Patent Application Serial No. 10201505358W, entitled "ELECTRICAL CONNECTOR" file on Jul. 7, 2015. The entire contents of these applications are incorporated herein by reference in their entirety.

FIELD OF THE INVENTION

The present invention relates to an electrical connector, and more particularly relates to an electrical board connector.

BACKGROUND

Electrical connectors are widely used in electrical systems for data communication, data storage, data transmission and the like. Board connectors have been used to establish electrical connections between printed circuit boards (PCBs) to which plug connector and counterpart receptacle connector are mounted respectively.

SUMMARY

According to an embodiment, an electrical connector includes a housing, first and second sets of terminals and a spacer. The housing has a first sidewall, a second sidewall spaced apart from the first sidewall and a cavity between the first and second sidewalls. The first set of terminals is disposed in the cavity adjacent to the first sidewall. The second set of terminals is disposed in the cavity adjacent to the second sidewall. The spacer is disposed in the cavity between the first and second sets of terminals.

Other aspects and advantages of the present invention will become apparent from the following detailed description, illustrating by way of example the inventive concept of the present invention.

BRIEF DESCRIPTION OF THE DRAWINGS

Embodiments of the invention are disclosed hereinafter with reference to the drawings, in which.

DETAILED DESCRIPTION

Figure 1:
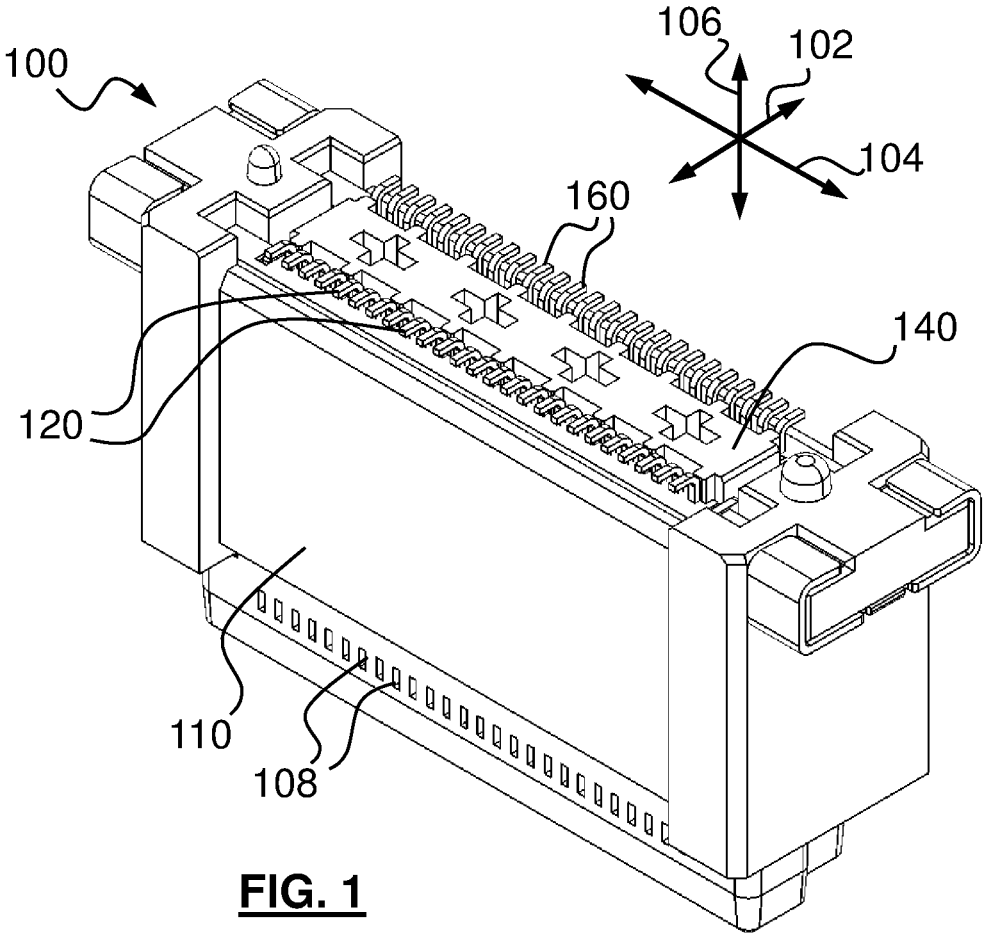
FIG. 1 is a perspective view of an electrical connector in accordance with one embodiment of the present invention.
Figure 2:
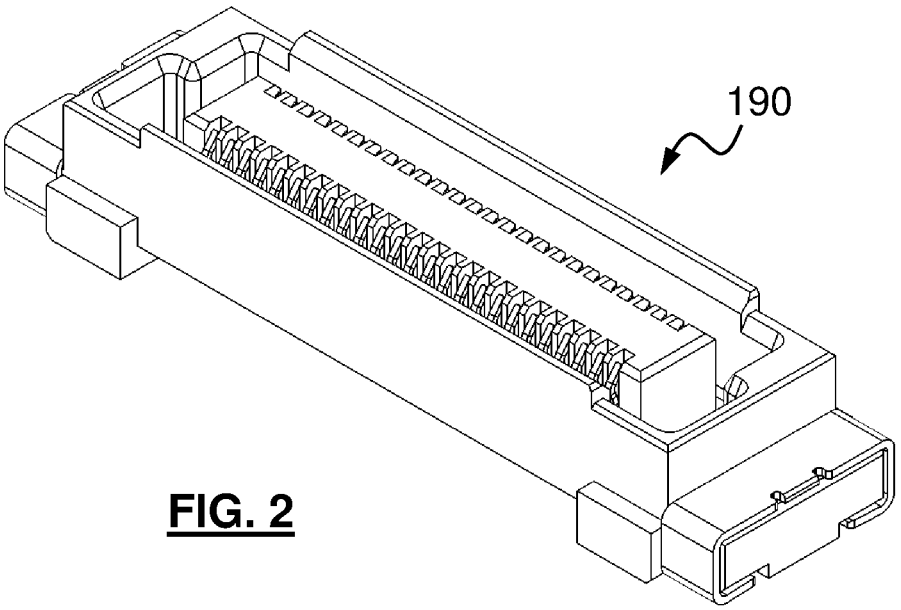
FIG. 2 is a perspective view of a counterpart connector for connecting to the board connector shown in FIG. 1.

As shown in FIGS. 1 to 5, an electrical connector 100 includes a housing 110, a first set of terminals 120, a second set of terminals 160 and a spacer 140. Housing 110 has a first sidewall 112 and a second sidewall 116 spaced apart from first sidewall 112, forming a cavity 114 between first and second sidewalls 112, 116. First set of terminals 120 is disposed in cavity 114 and adjacent to first sidewall 112. Second set of terminals 160 is disposed in cavity 114 and adjacent to second sidewall 116. Spacer 140 is disposed in cavity 114 between first set of terminals 120 and second set of terminals 160. Housing 110 defines a depth direction 102, a width direction 104 perpendicular to depth direction 102 and a height direction 106 perpendicular to depth direction 102 and width direction 104.

Figure 3:
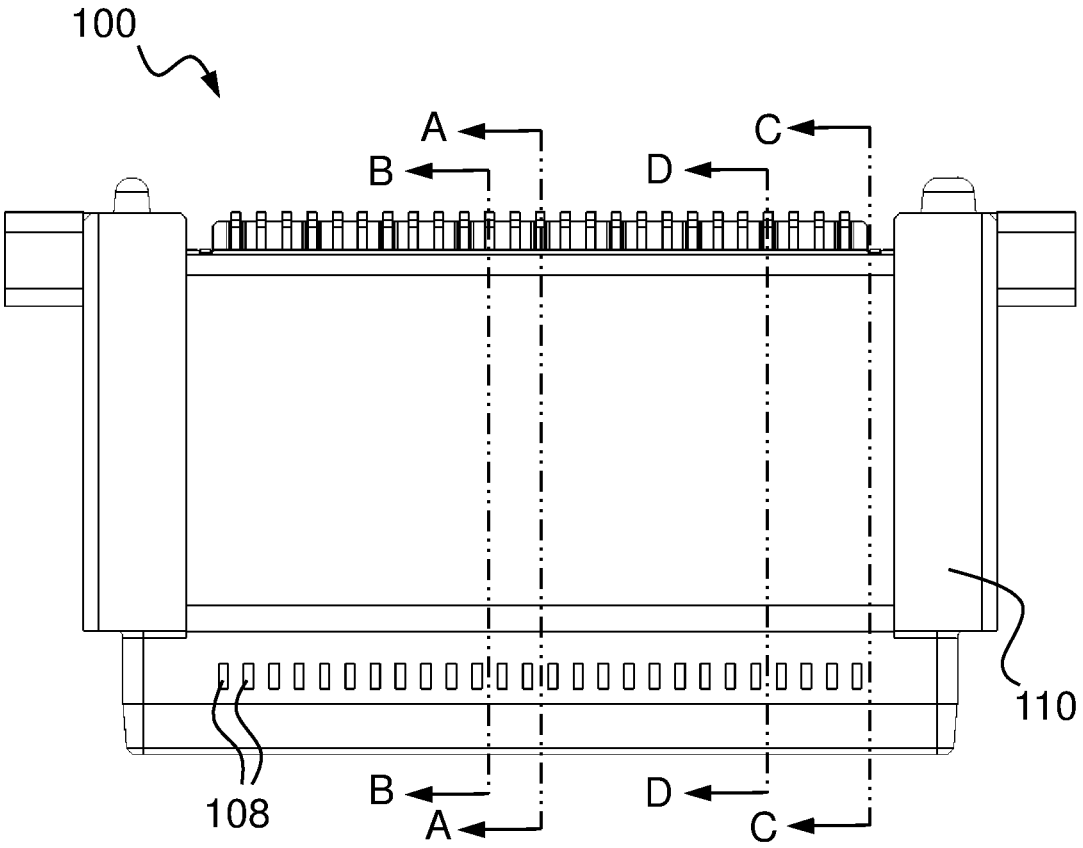
FIG. 3 is a front view of FIG. 1.
Figure 4:
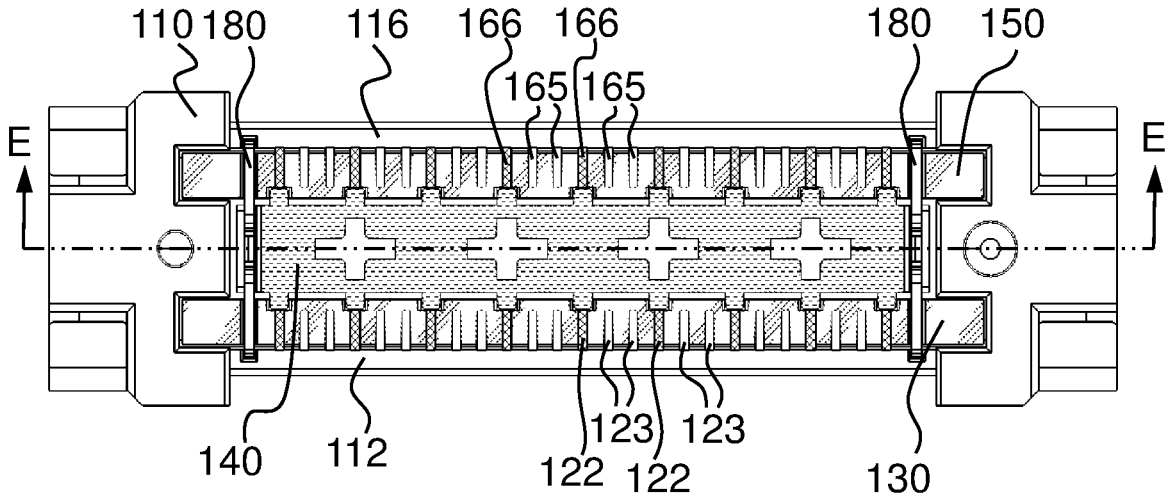
FIG. 4 is a top view of FIG. 1.
Figure 5:
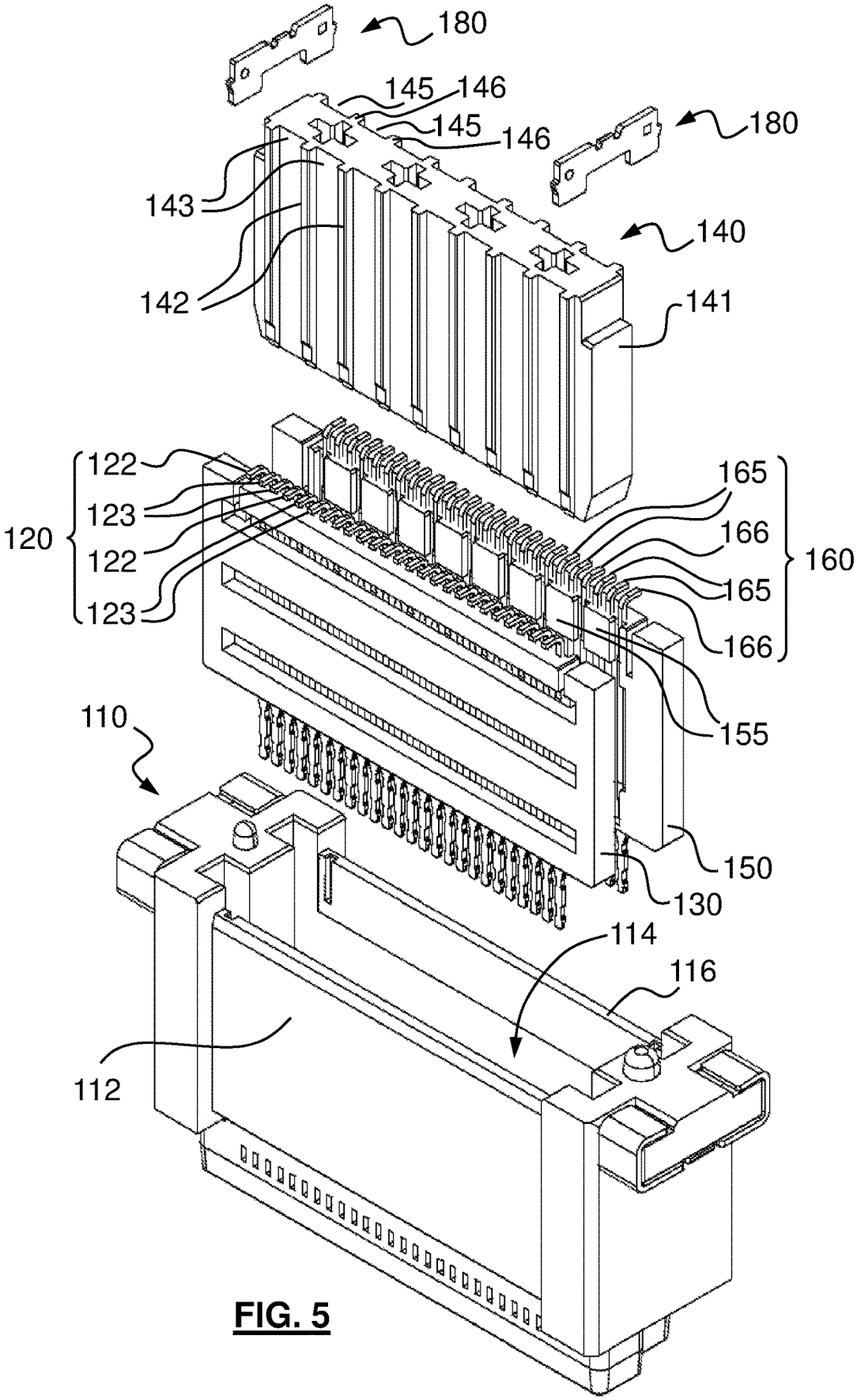
FIG. 5 is an exploded perspective view of the electrical connector shown in FIG. 1.

As shown in FIGS. 1, 3 and 4, first set of terminals 120 includes first signal pairs 123 and first ground terminals 122. Each of the first ground terminals 122 is disposed between adjacent first signal pairs 123. Second set of terminals 160 includes second signal pairs 165 and second ground terminals 166. Each of the second ground terminals 166 is disposed between adjacent second signal pairs 165. Housing 110 has windows 108 formed on first and second sidewalls 112, 116 (only windows 108 on first sidewall 112 are shown), corresponding to the positions of first and second signal pairs 123, 165. Spacer 140 is positioned closer to first and second ground terminals 122, 166 than to the first and second signal pairs 123, 165. Spacer 140 may be in contact with first and second ground terminals 122, 166 or alternatively, spacer 140 is spaced apart from the first and second ground terminals 122, 166 with an air gap. Windows 108 provide air space for first and second ground terminals 122, 166 which contributes to signal integrity performance of electrical connector 100.

Spacer 140 is electrically coupled to first and second ground terminals 122, 166 to serve as a resonant damping component to improve signal integrity of electrical connector 100.

Figure 6:
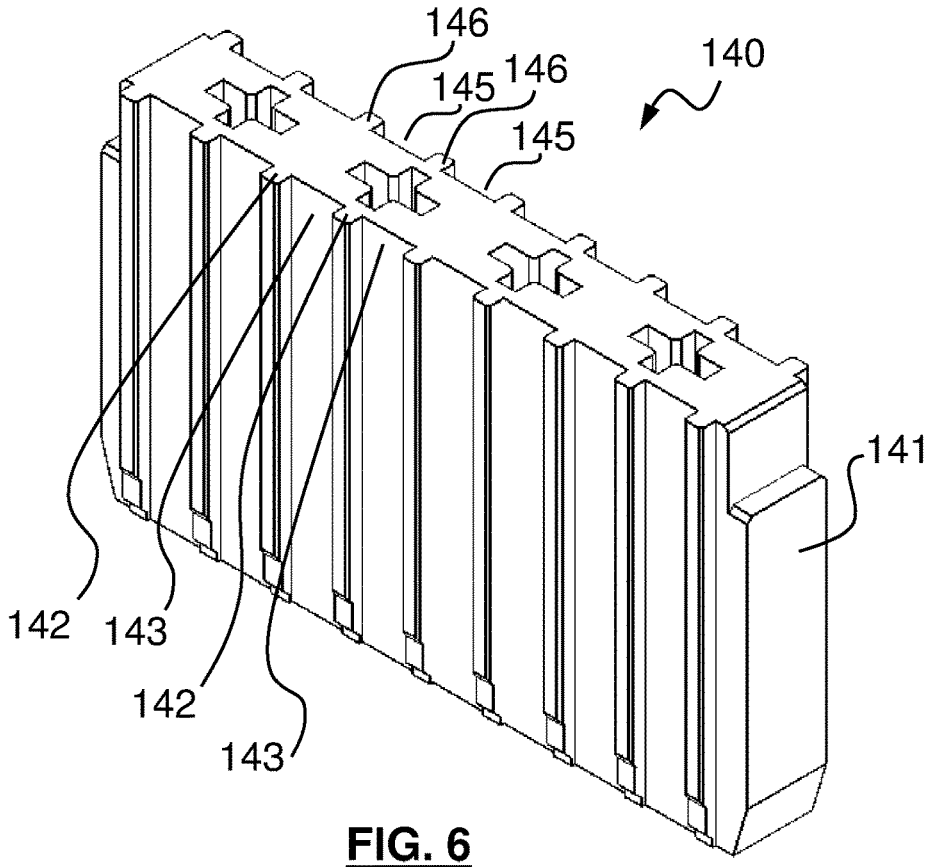
FIG. 6 is a perspective top view showing the spacer of the electrical connector of FIG. 1.
Figure 7:
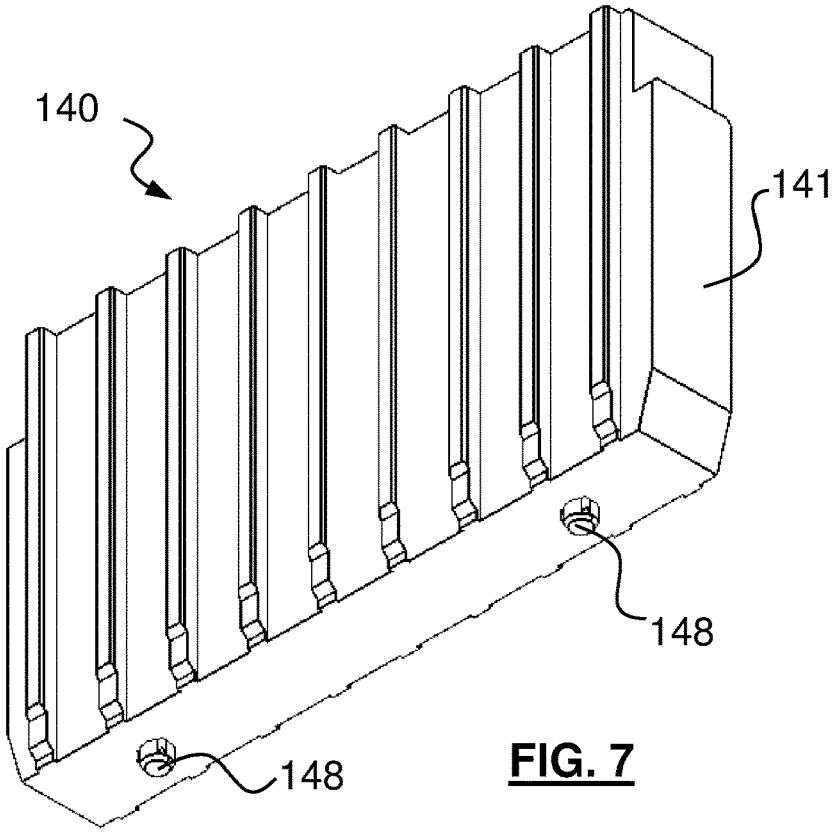
FIG. 7 is a perspective bottom view showing the spacer of FIG. 6.

First signal pairs 123 and first ground terminals 122 may be disposed in a first plane. Second signal pairs 165 and second ground terminals 166 may be disposed in a second plane. As shown in FIGS. 6 and 7, Spacer 140 has a base 141. At one side of base 141 there are formed first ridges 142 projecting from base 141 and facing first set of terminals 120. At an opposite side of base 141 there are formed second ridges 146 projecting from base 141 and facing second set of terminals 160. Between adjacent first ridges 142 there is formed a first notch 143. Between adjacent second ridges 146 there is formed a second notch 145. Each of the first ridges 142 is in alignment with one of the first ground terminals 122 with respect to width direction 104 of housing 110. Each of the second ridges 146 is in alignment with one of the second ground terminals 166 with respect to width direction 104 of housing 110. Each of the first ridges 142 is in contact with one of the first ground terminals 122, each of the second ridges 166 is in contact with the one of the second ground terminals 166. Alternatively, each of the first ridges 142 is spaced apart from one of the first ground terminals 122 with an air gap, and each one of the second ridges 146 is spaced apart from one of the second ground terminals 166 with an air gap.

In one embodiment, as shown with further details in FIGS. 6 to 20, electrical connector 100 includes a first frame 130 and a second frame 150. First frame 130 is molded to and supporting first set of terminals 120, to form a first Insert-Molded Leadframe Assembly (IMLA) 120*a*. Second frame 150 is molded to and supporting second set of terminals 160, to form a first Insert-Molded Leadframe Assembly (IMLA) 160*a*. First and second IMLAs 120*a*, 106*a* have symmetrical structures and dimensions, hence illustrations and references made in the context to one of the IMLAs applies to those made to the other one of the IMLAs, in conduction with FIGS. 8 and 9. First frame 130 is disposed between first sidewall 112 of housing 110 and spacer 140. Second frame 150 is disposed between second sidewall 116 of housing 110 and spacer 140.

Figure 8:
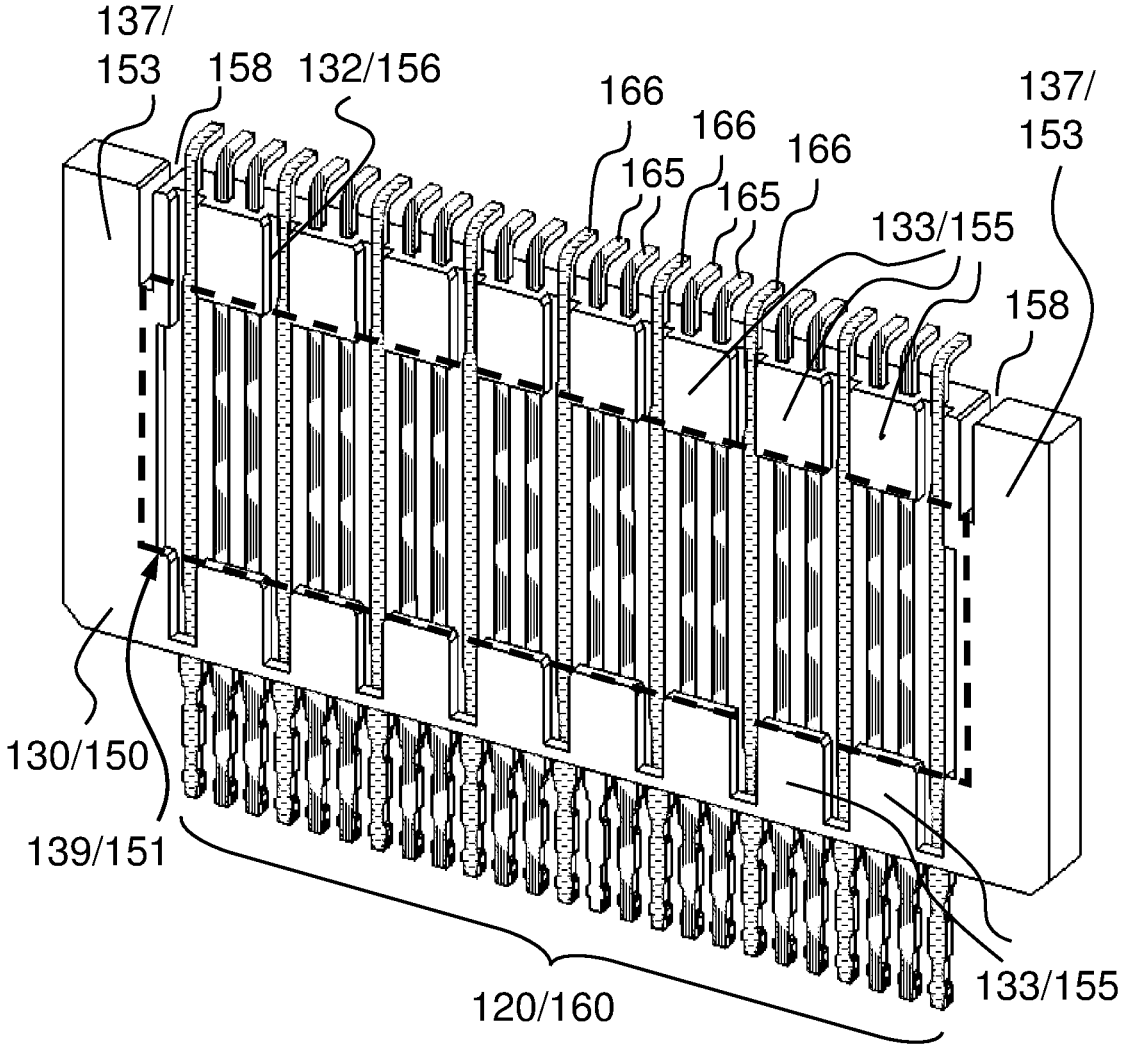
FIG. 8 is a perspective view showing the first set of terminals of the electrical connector of FIG. 1.
Figure 9:
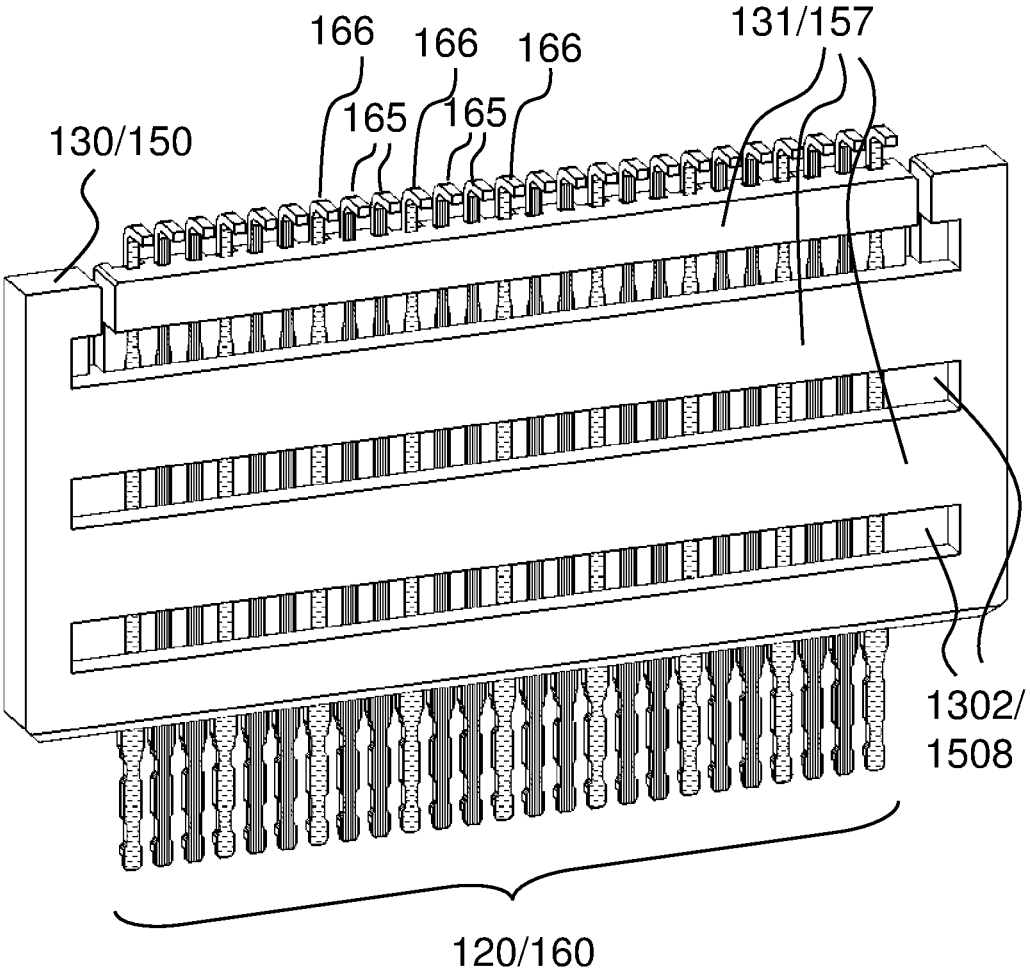
FIG. 9 is a perspective view the first set of terminals of FIG. 8 from another viewing angle.
Figure 10:
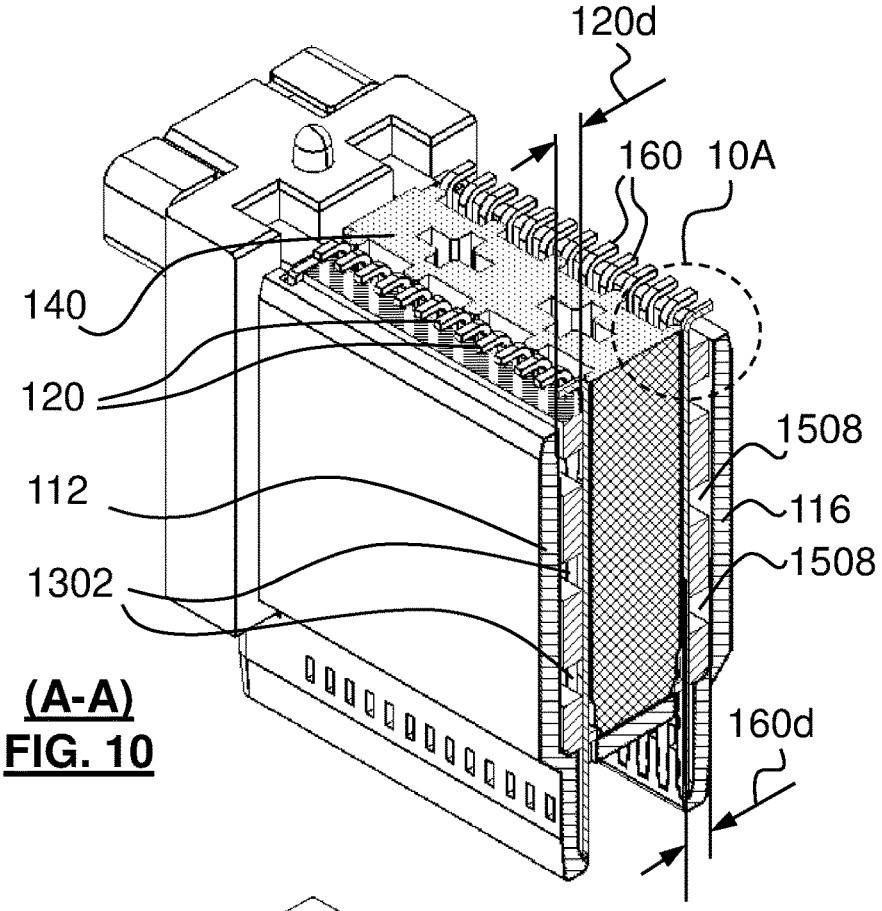
FIG. 10 is a cross sectional perspective view of the electrical connector shown in FIG. 3 along A-A, FIG. 11 cross sectional perspective view of the electrical connector shown in FIG. 3 along B-B.
Figure 11:
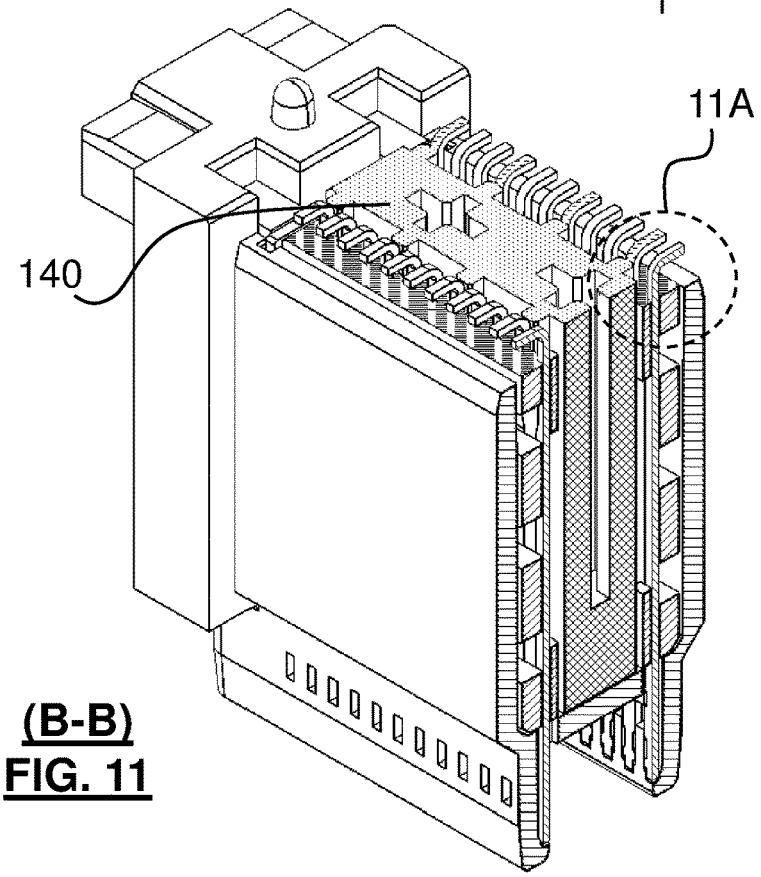
Figure 12:
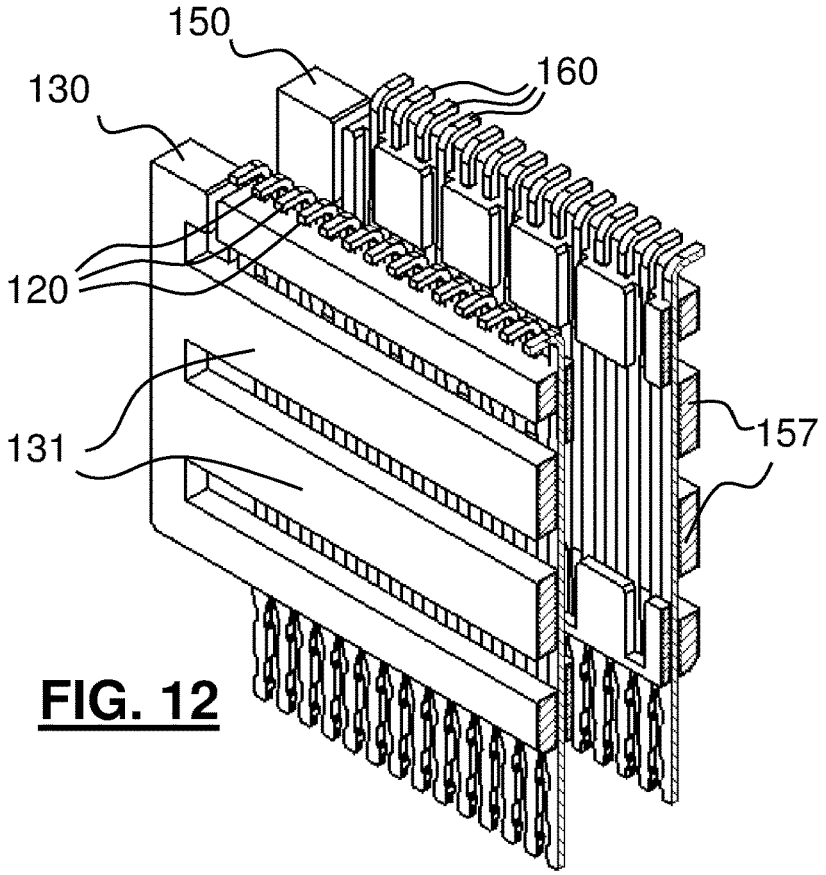
FIG. 12 is a perspective view of showing the first and second sets of terminals of the electrical connector shown in FIG. 10.
Figure 13:
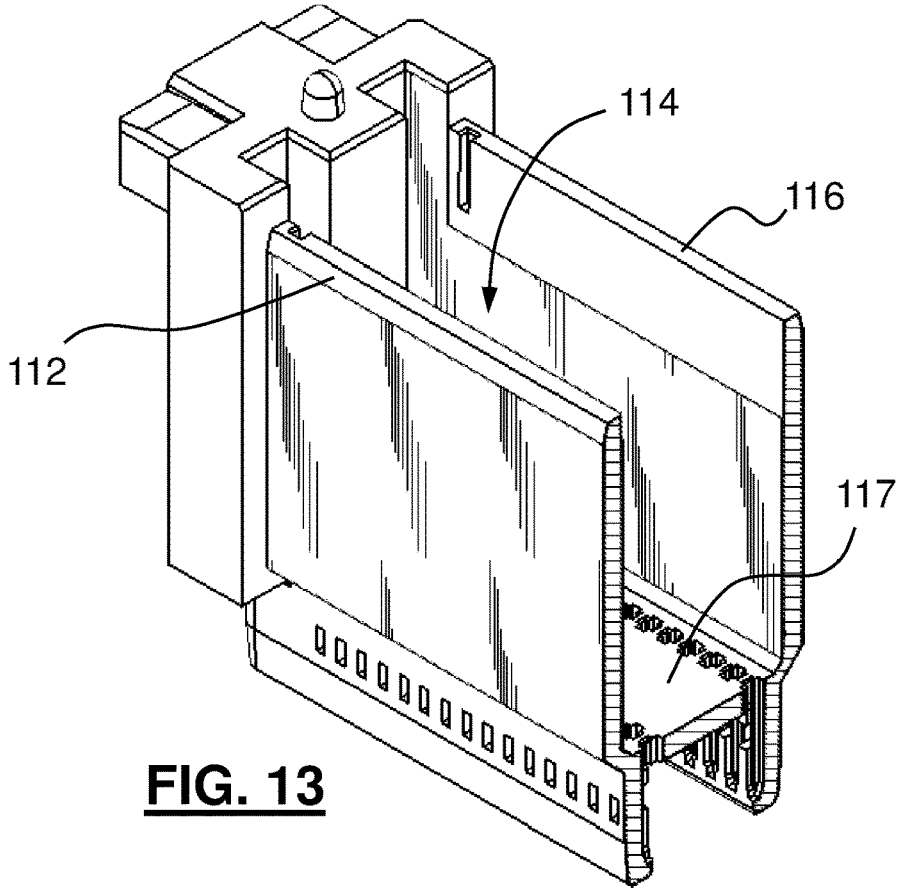
FIG. 13 is a perspective view of showing the housing of the electrical connector shown in FIG. 10.

As shown in FIGS. 8 and 9, first frame 130 has side columns 137 and first protuberances 133 facing spacer 140 and notches 132 between protuberances 133. Second frame 150 has second columns 153 and second protuberances 155 facing spacer 140, and notches 156 between protuberances 155. Each one of the first ridges 142 of spacer 140 is disposed in one of the first notches 132, each one of the second ridges 146 of spacer 140 is disposed in one of the second notches 156. Each one of the first and second protuberances 133, 155 is received between adjacent first and second ridges 143, 145 of spacer 140, respectively. First columns 137 and first protuberances 133 form a first recess 139 on first IMLA 120*a*, facing spacer 140 Likewise second columns 153 and second protuberances 155 form a second recess 151 on second IMLA 160*a*, facing spacer 140. The segment of first set of terminals 120 within first recess 139 are dented with respect to first columns 137 and first protuberances 133, and the segment of second set of terminals 160 within second recess 151 are dented with respect to second columns 153 and second protuberances 155. As such, there is formed an air gap between the first set of terminals 120 and spacer 140, and an air gap between the second set of terminals 160 and spacer 140. The air gaps serve to improve signal integrity performance between the signal contacts and spacer 140.

First frame 130 has first ribs 131 facing first sidewall 112 of housing 110. Second frame 150 has second ribs 157 facing second sidewall 116 of housing 110. First ribs 131 separate first set of terminals 120 from first sidewall 112 of housing 110. Second ribs 157 separate second set of terminals 160 from second sidewall 116 of housing 110.

Between first ribs 131 there are formed first openings 1302 through which first set of terminals 120 are partially exposed. Between second ribs 157 there are formed second openings 1508 through which second set of terminals 160 are partially exposed.

As shown in FIGS. 10 to 15, first set of terminals 120 is positioned with a distance 120*d* from first sidewall 112 of housing 110. Second set of terminals 160 is positioned with a distance 160*d* from second sidewall 116 of housing 110. First and second openings 1302, 1508 are formed for insert molding process of producing IMPAs 120*a*, 160*a*.

Figure 14:
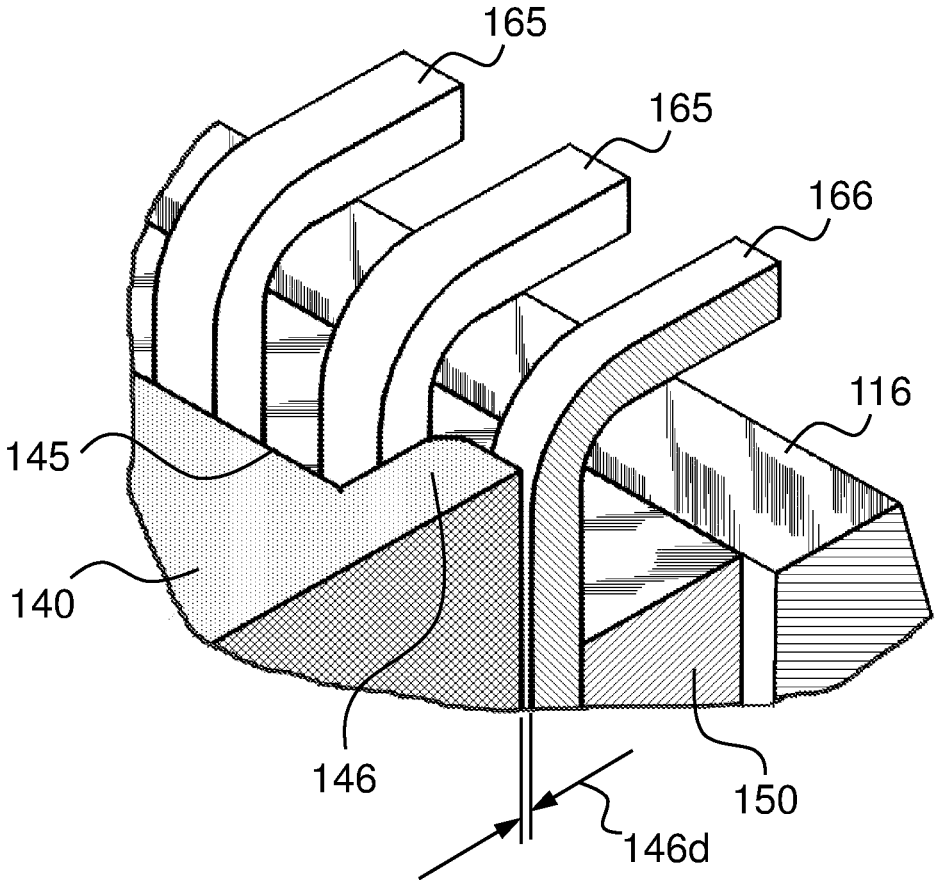
FIG. 14 is an enlarged view of portion 10A of FIG. 10.
Figure 15:
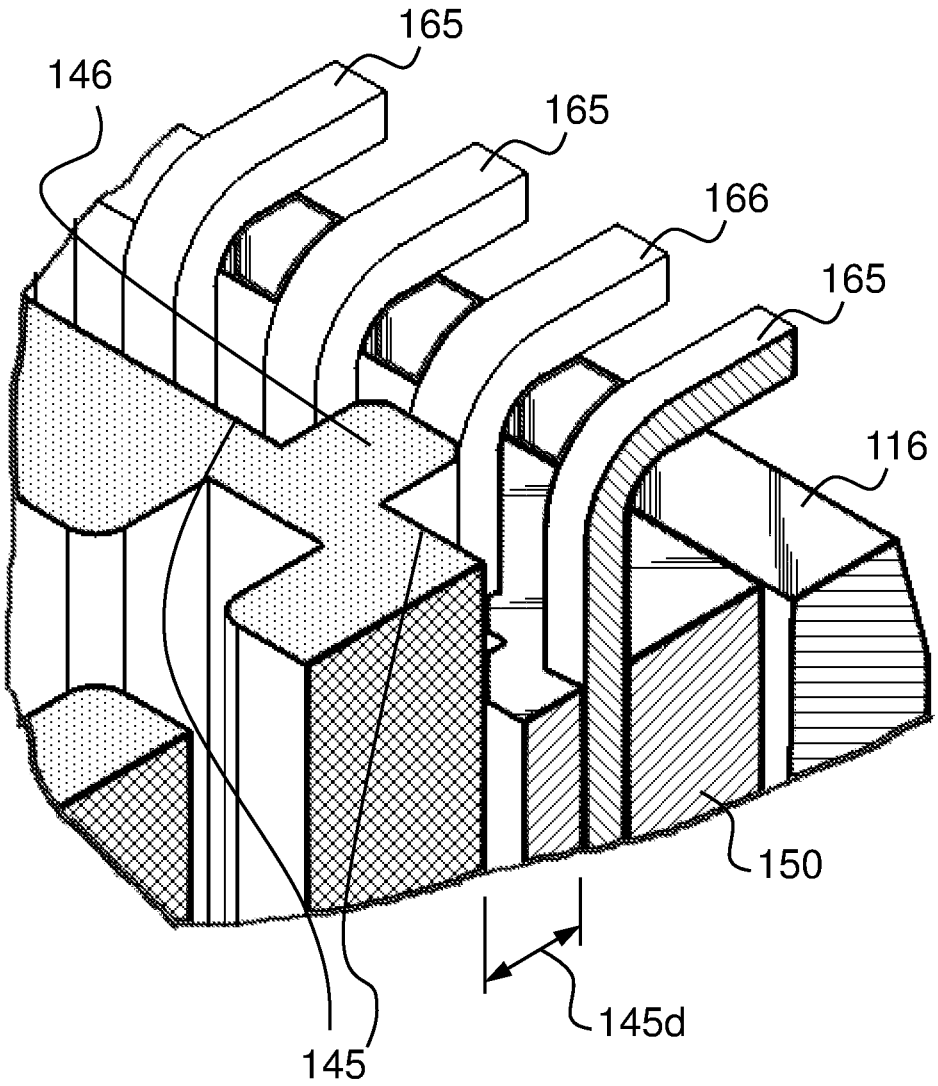
FIG. 15 is an enlarged view of portion 11A of FIG. 11.

FIGS. 14 and 15 shows the positional relationship between spacer 140 and second ground terminals 166, and that between spacer 140 and second signal pairs 165. The positional relationship between spacer 140 and first ground terminals and first signal pairs is the same. As shown in FIGS. 14 and 15, a distance between second ridge 146 of spacer 140 and a second ground terminal 166 is denoted as distance 146*d*. A distance between second notch 145 and a second signal pair 165 is denoted as distance 145*d*, in which, distance 145*d* is greater than distance 146*d*. Another words, spacer 140 is positioned closer to first and second ground terminals 122, 166 of first and second set of terminals 120, 160 to effect electrical coupling between spacer 140 and first and second ground terminals 122, 166 and achieve signal integrity improvement.

Figure 16:
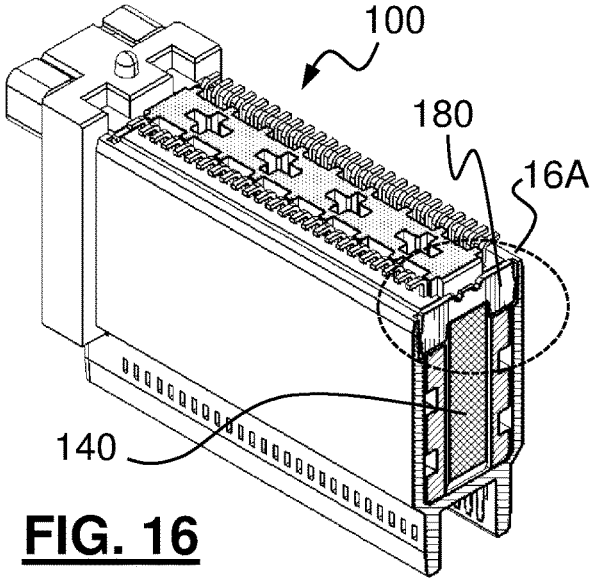
FIG. 16 is a cross sectional perspective view of the electrical connector shown in FIG. 3 along C-C.
Figure 17A:
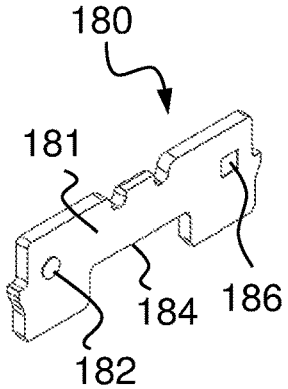
FIG. 17A is a perspective view showing a fixing tab of electrical connector of FIG. 16.
Figure 17B:
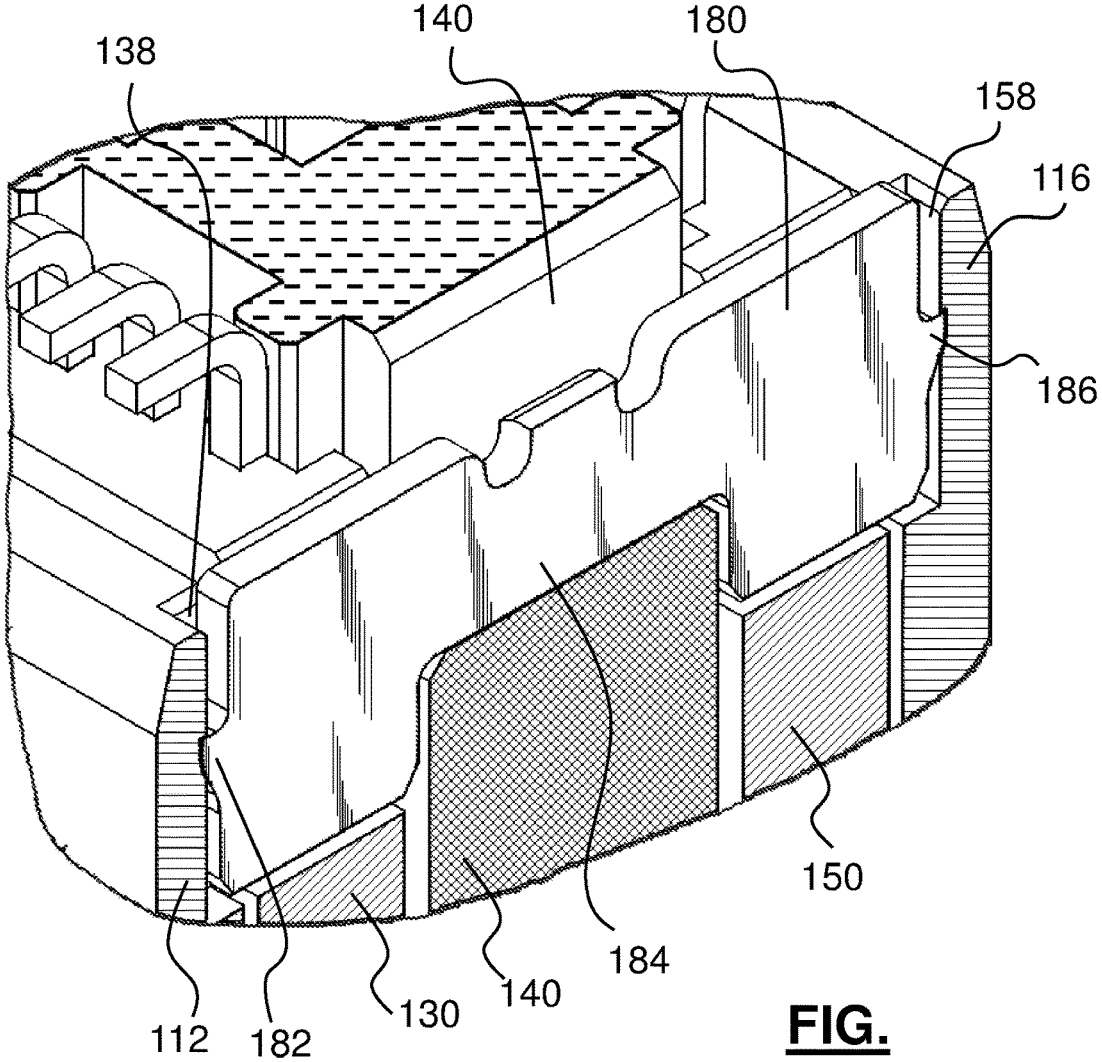
FIG. 17B is an enlarged view of portion 16A of FIG. 16.

As shown in FIGS. 16 and 17A and 17B, electrical connector 100 includes a pair of fixing tabs 180 secured to housing 110 and engaged to spacer 140. Each of the first and second frames 130, 150 has a pair of grooves 138, 158 into which each one of the fixing tabs 180 is fitted. Each fixing tab 180 has barbs 186 biting into sidewalls 112, 116 of housing 110 such that fixing tabs 180 are securely fixed to housing 110. Each fixing tab 180 has a main body 181 and first and second bosses 182, 186 raised from main body 181. Main body 181 is received into grooves 138, 158 with first and second bosses 182, 186 forced into respective first and second frames 130, 150 in the first and second grooves 138, 158. Each fixing tab 180 has a middle portion 184 engaged to spacer 140 to fix spacer 140 to housing 110.

Figure 18:
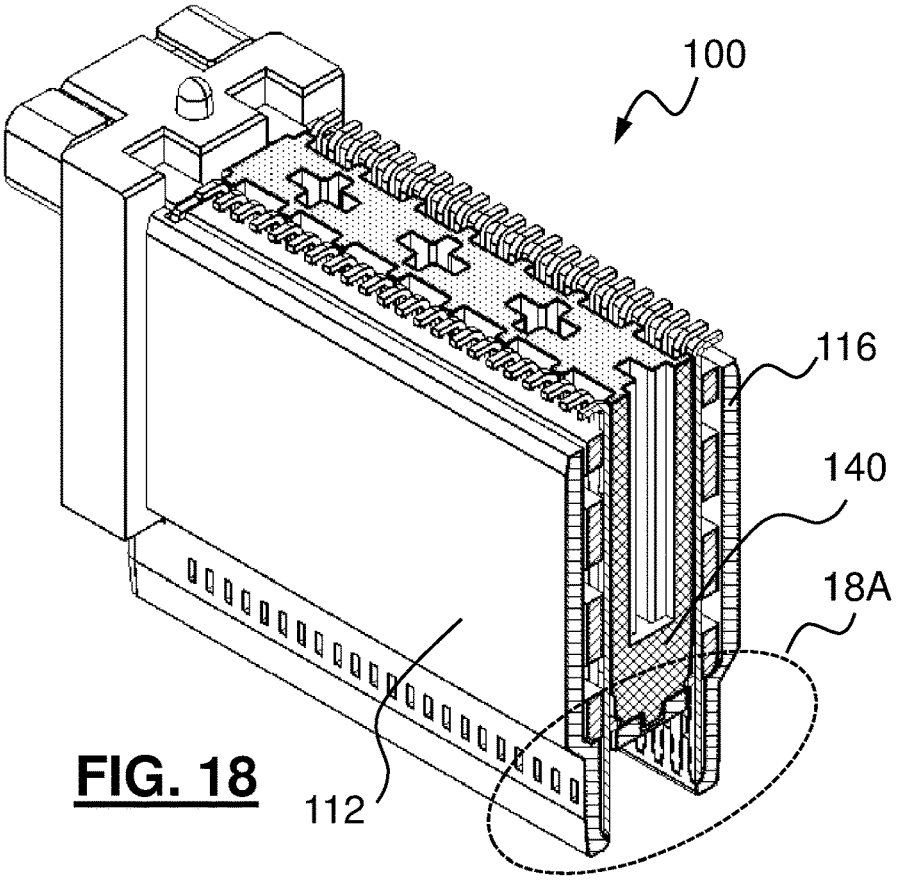
FIG. 18 is a cross sectional perspective view of the electrical connector shown in FIG. 3 along D-D.
Figure 19:
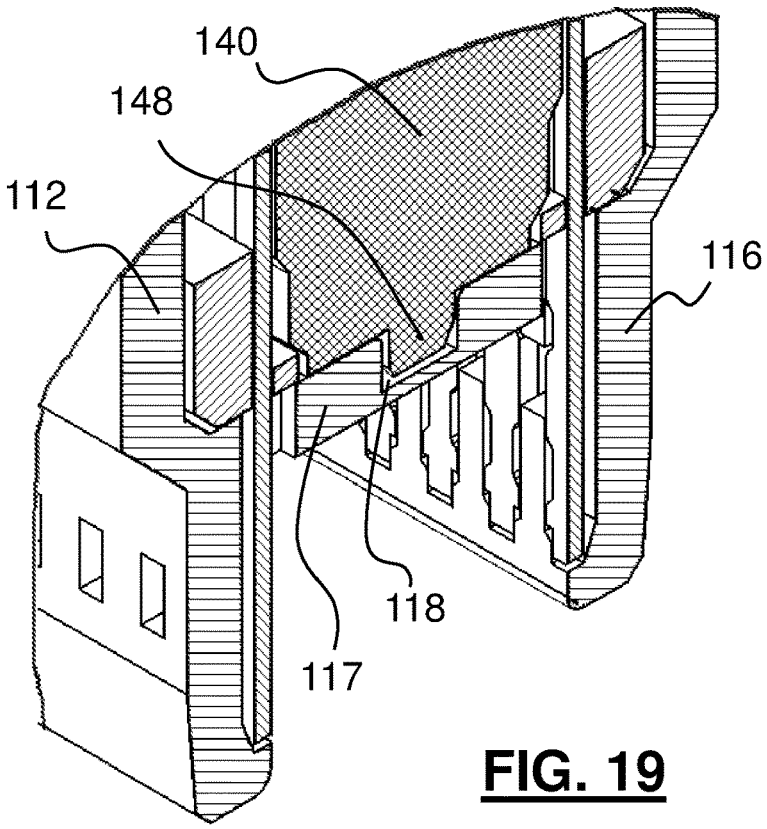
FIG. 19 is an enlarged view of portion 18A of FIG. 18.
Figure 20:
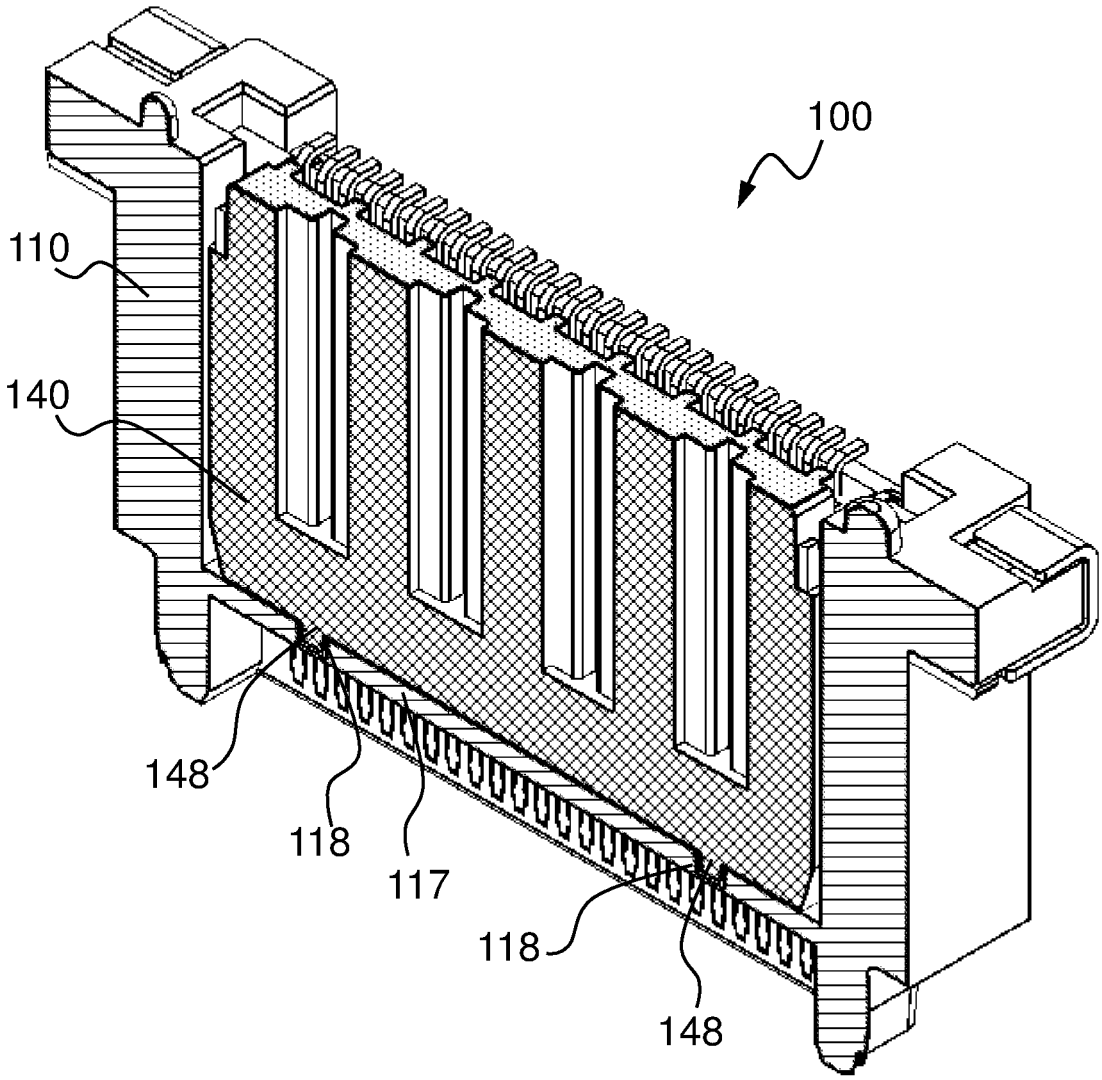
FIG. 20 is a cross sectional perspective view of the electrical connector shown in FIG. 4 along E-E.
Figure 21:
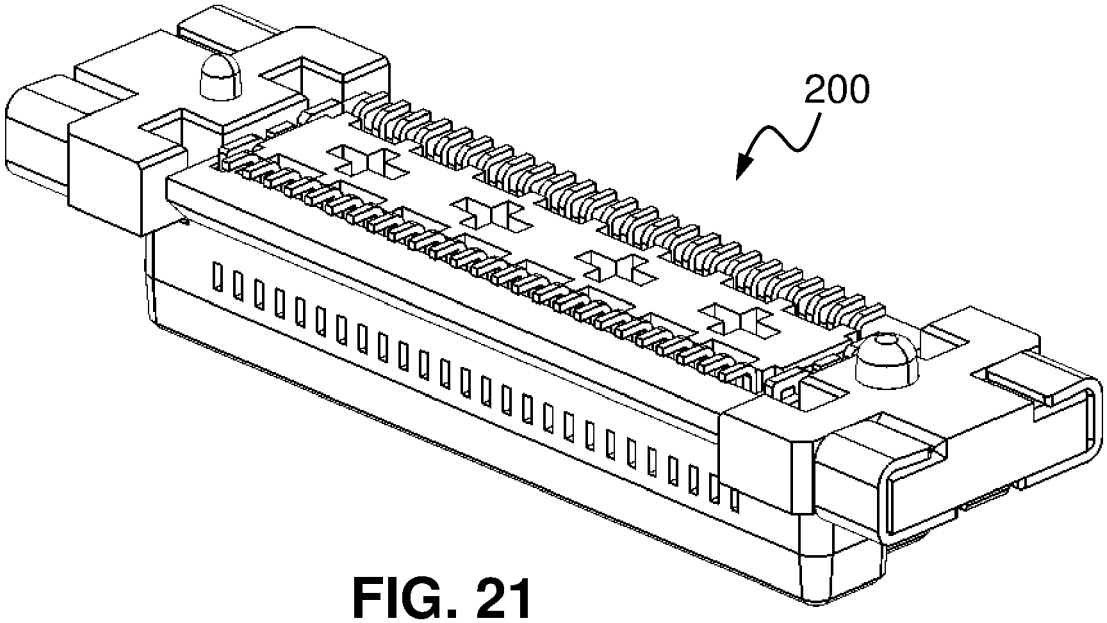
FIG. 21 is a perspective view of an electrical connector in accordance with another embodiment of the present invention.
Figure 22:
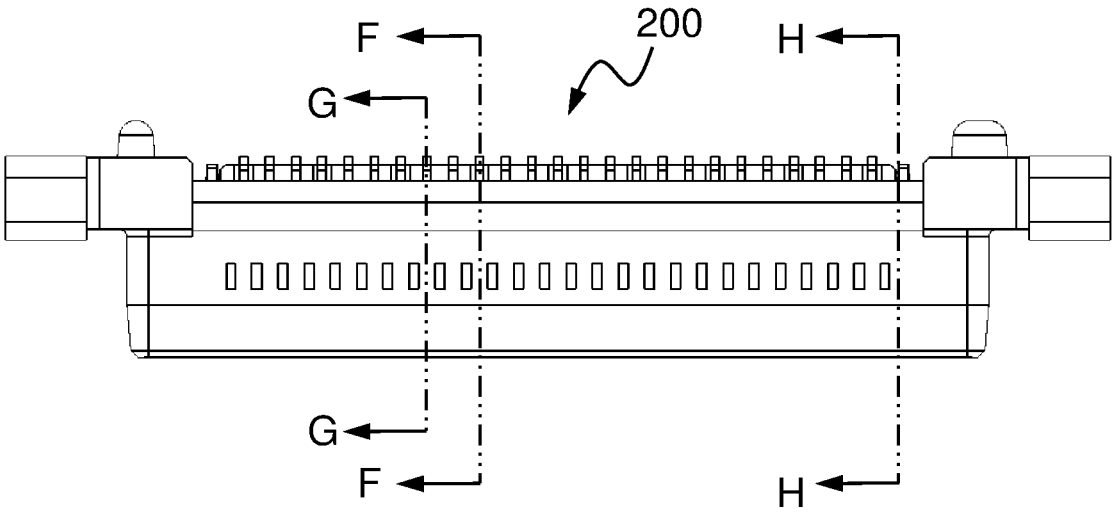
FIG. 22 is a front view of FIG. 21.
Figure 23:
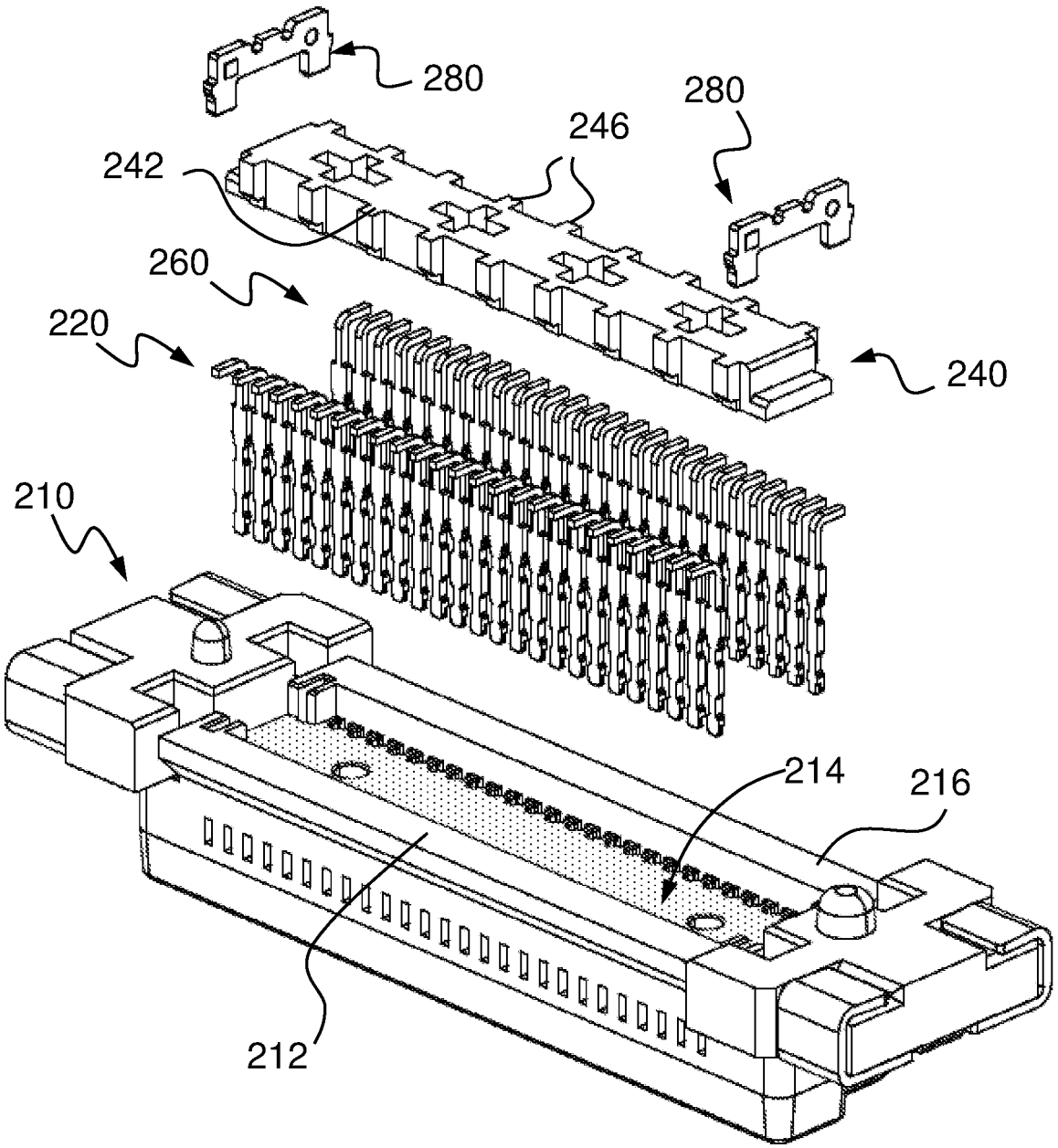
FIG. 23 is an exploded perspective view of the electrical connector shown in FIG. 21.
Figure 24:
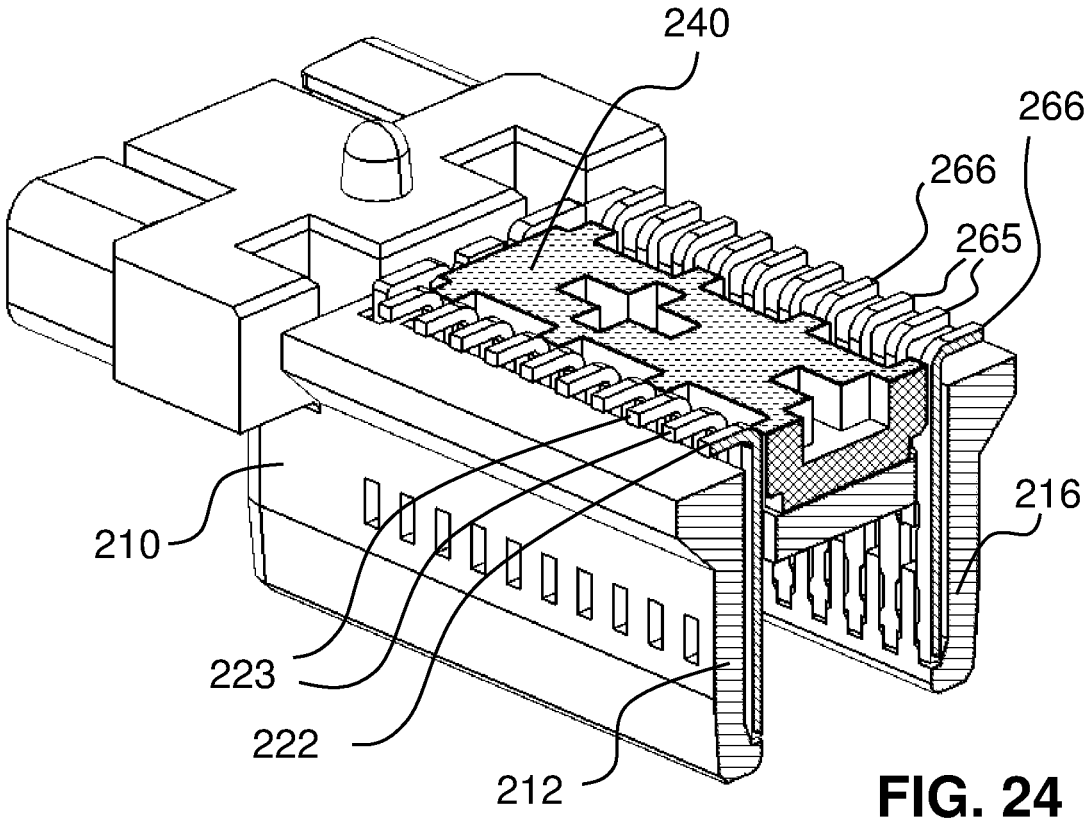
FIG. 24 is a cross sectional perspective view of the electrical connector shown in FIG. 22 along F-F.
Figure 25:
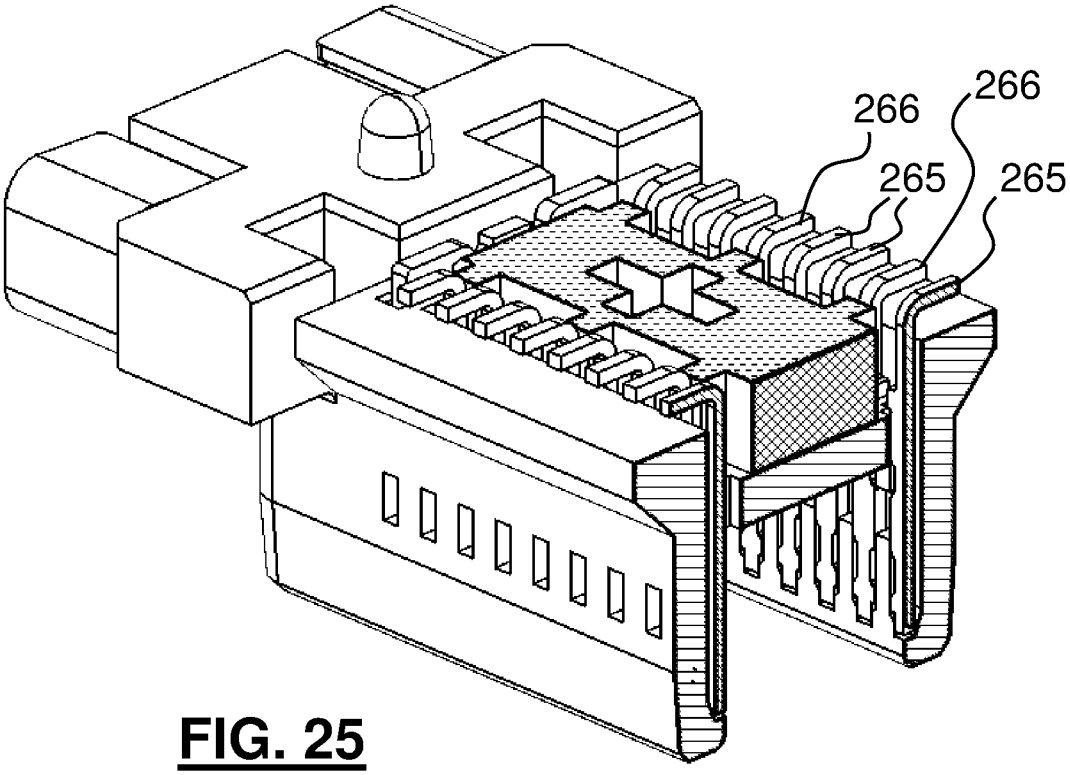
FIG. 25 is a cross sectional perspective view of the electrical connector shown in FIG. 22 along G-G.
Figure 26:
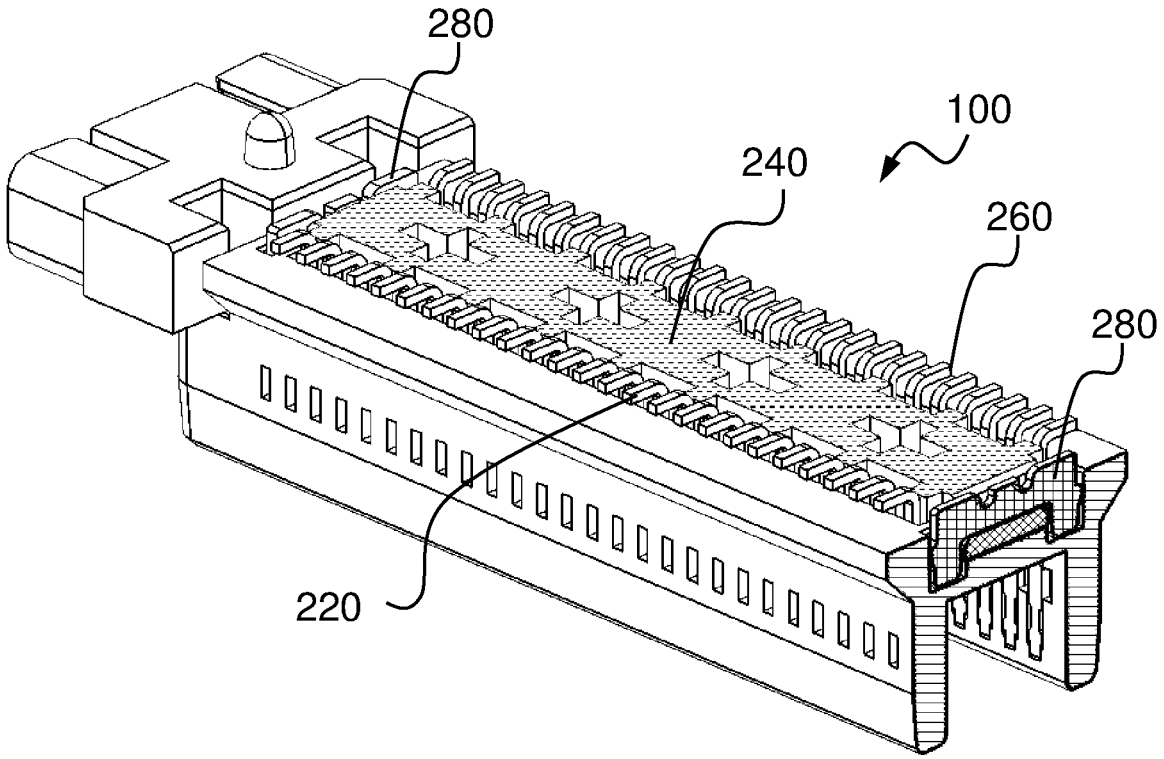
FIG. 26 is a cross sectional perspective view of the electrical connector shown in FIG. 22 along H-H.

As shown in FIGS. 18 to 20, connected to first and second sidewalls 112, 116 of housing 110 there is a partition 117 onto which spacer 140 is seated. Partition 117 has one or more recesses 118 formed thereon and accessible through cavity 114. Spacer 140 may include one or more pins 148 projecting downward from bottom surface thereof. Each pin 148 is received into a recess 118 such that movement of spacer 140 relative to housing 110 along depth direction 102 and width direction 104 is prevented.

In another embodiment, as shown in FIGS. 21 to 26, an electrical connector 200 includes a housing 210, first and second sets of terminals 220, 260, and a spacer 240. Housing 210 has a first sidewall 212 and a second sidewall 216 spaced apart from first sidewall 212, and a cavity 214 between first and second sidewalls 212, 216. First set of terminals 220 is disposed in cavity 214 adjacent to first sidewall 212, and second set of terminals 260 is disposed in cavity 214 adjacent to second sidewall 216. Spacer 240 is disposed in cavity 214 between first and second set of terminals 220, 260.

Electrical connector 200 is of a low-profile structure having a relatively smaller height dimension compared to that of the previous embodiment. First and second set of terminals 220, 260 are respectively attached to first and second sidewalls 212, 216 without additional support of a frame. First and second signal pairs 223, 265 are positioned in a relatively greater distance from spacer 240 and spacer 240 is electrically coupled to first and second ground terminals 222, 266 by being positioned closer to such ground terminals, via ridges 242, 246 projecting from spacer 240.

Similar to the previous embodiment, electrical connector 200 includes a pair of fixing tabs 280 fixed to housing 210 to secure spacer 240 to housing to ensure the correct positional relationship with first and second set of terminals 220, 260.

Although embodiments of the present invention have been illustrated in conjunction with the accompanying drawings and described in the foregoing detailed description, it should be appreciated that the present invention is not limited to the embodiments disclosed. Therefore, the present invention should be understood to be capable of numerous rearrangements, modifications, alternatives and substitutions without departing from the spirit of the invention as set forth and recited by the following claims.

The invention claimed is:

1. An electrical connector comprising:

a housing having a first sidewall, a second sidewall spaced apart from the first sidewall, and a cavity between the first and second sidewalls;

a first set of terminals disposed in the cavity adjacent to the first sidewall;

a second set of terminals disposed in the cavity adjacent to the second sidewall;

a spacer disposed in the cavity between the first and second sets of terminals, wherein the spacer comprises:

a base;

first ridges projecting from the base toward the first sidewall of the housing; and second ridges projecting from the base toward the second sidewall of the housing;

a first frame supporting the first set of terminals, the first frame comprising:

first protuberances facing the spacer:, and a first notch between adjacent ones of the first protuberances;

a second frame supporting the second set of terminals, the second frame comprising:

second protuberances facing the spacer:, and a second notch between adjacent ones of the second protuberances, wherein one of the first ridges of the spacer is disposed in one of the first notches, and one of the second ridges of the spacer is disposed in one of the second notches.

2. The electrical connector as recited in claim 1, wherein:

the housing comprises a partition connected to the first and second sidewalls, the partition has a recess formed thereon, and the spacer has a pin received in the recess.

3. The electrical connector as recited in claim 1, wherein the spacer is a resonant damping component.

4. The electrical connector as recited in claim 1, wherein:

the first set of terminals comprises first signal pairs and first ground terminals, each one of the first ground terminals is disposed between adjacent ones of the first signal pairs, the second set of terminals comprises second signal pairs and second ground terminals, each one of the second ground terminals is disposed between adjacent ones of the second signal pairs, and the spacer is electrically coupled to the first and second ground terminals.

5. The electrical connector as recited in claim 4, wherein:

the housing further comprises windows on the first and second sidewalls thereof, each of the first and second signal pair includes two signal terminals, and each window is positioned in alignment with one of the two signal terminals to provide an air space thereto.

6. The electrical connector as recited in claim 4, wherein the spacer is positioned closer to the first and second ground terminals than to the first and second signal pairs.

7. The electrical connector as recited in claim 6, wherein the spacer is in contact with the first and second ground terminals.

8. The electrical connector as recited in claim 6, wherein the first signal pairs and the first ground terminals are disposed in a first plane, the second signal pairs and the second ground terminals are disposed in a second plane; each one of the first ridges being in alignment with one of the first ground terminals with respect to a width direction of the housing, and each one of the second ridges being in alignment with one of the second ground terminals with respect to the width direction of the housing.

9. The electrical connector as recited in claim 8, wherein each one of the first ridges is in contact with a respective one of the first ground terminals, each one of the second ridges is in contact with a respective one of the second ground terminals.

10. The electrical connector as recited in claim 4, wherein the first frame is disposed between the first sidewall of the housing and the spacer, and the second frame is disposed between the second sidewall and the spacer.

11. The electrical connector as recited in claim 10, wherein:

the first frame has first ribs facing the first sidewall of the housing, the second frame has second ribs facing the second sidewall of the housing, the first ribs separate the first set of terminals from the first sidewall of the housing, and the second ribs separate the second set of terminals from the second sidewall of the housing.

12. The electrical connector as recited in claim 10, wherein each one of the first and second protuberances is received between adjacent first and second ridges of the spacer respectively.

13. The electrical connector as recited in claim 12, wherein:

the first frame has first columns forming a first recess with the first protuberances, the second frame has second columns forming a second recess with the second protuberances, the first recess faces the spacer to form a first air gap between the first set of terminals and the spacer, and the second recess faces the spacer to form a second air gap between the second set of the terminals and the spacer.

14. The electrical connector as recited in claim 10, further comprising a pair of fixing tabs secured to the housing and engaged to the spacer, wherein each of the first and second frames has a respective first and second pair of grooves into which each one of the fixing tabs is fitted.

15. The electrical connector as recited in claim 14, wherein each fixing tab has a main body and first and second bosses raised from the main body, the main body being fitted into the first and second grooves and the first and second bosses being forced into the respective first and second frames in the first and second grooves.

16. An electrical connector comprising:

a housing having a first sidewall, a second sidewall spaced apart from the first sidewall, and a cavity between the first and second sidewalls;

a first set of terminals disposed in the cavity adjacent to the first sidewall;

a second set of terminals disposed in the cavity adjacent to the second sidewall;

at least one member disposed in the cavity between the first and second sets of terminals so as to establish a space between the first and second sets of terminals; and a pair of fixing tabs secured to the housing and engaged to at least one of the at least one member, wherein:

the first and second sets of terminals comprise tail ends with first surfaces extending in a first direction, and the fixing tabs of the pair of fixing tabs comprise second surfaces that are coplanar with the first surfaces and extend in the first direction.

17. An electrical connector, comprising:

a housing having a first sidewall, a second sidewall spaced apart from the first sidewalk, and a cavity between the first and second sidewalls;

a first set of terminals supported by a first frame and disposed in the cavity adjacent to the first sidewall;

a second set of terminals supported by a second frame and disposed in the cavity adjacent to the second sidewall; and a resonant damping component disposed in the cavity;

wherein the first frame comprises a first plurality of notches aligned with ones of the first set of terminals and disposed between adjacent pairs of the first set of terminals; and wherein the second frame comprises a second plurality of notches aligned with ones of the second set of terminals and disposed between adjacent pairs of the second set of terminals.

18. The electrical connector as recited in claim 17, wherein the resonant damping component comprises a plurality of projections extending towards ground conductors of the first and second sets of terminals.

19. The electrical connector as recited in claim 17, wherein:

the first set of terminals comprises first signal pairs and first ground terminals, each one of the first ground terminals is disposed between adjacent ones of the first signal pairs, the second set of terminals comprises second signal pairs and second ground terminals, each one of the second ground terminals is disposed between adjacent ones of the second signal pairs, and the resonant damping component is electrically coupled to the first and second ground terminals.

20. The electrical connector as recited in claim 19, wherein a cross-section of the resonant damping component comprises first ridges projecting from a first side of the cross-section towards the first set of terminals and second ridges projecting from a second side of the cross-section towards the second set of terminals.

21. The electrical connector as recited in claim 20, wherein:

the resonant damping component is a spacer having a base;

the first ridges of the resonant damping component are first ridges of the spacer projecting from the base toward the first sidewall of the housing; and the second ridges of the resonant damping component are second ridges of the spacer projecting from the base toward the second sidewall of the housing.

22. The electrical connector as recited in claim 20, wherein the first ridges are in alignment with respective ones of the first ground terminals, and wherein the second ridges are in alignment with respective ones of the second ground terminals.

23. The electrical connector as recited in claim 22, wherein the first ridges are in contact with the respective ones of the first ground terminals, and wherein the second ridges are in contact with the respective ones of the second ground terminals.

24. The electrical connector as recited in claim 23, wherein the first ridges are configured to be received in respective ones of the first plurality of notches, and wherein the second ridges are configured to be received in respective ones of the second plurality of notches.

25. The electrical connector as recited in claim 24, wherein the resonant damping component is disposed at an end of the cavity adjacent a mounting interface of the electrical connector.

* * * * *